US007968502B2

(12) United States Patent
Konishi et al.

(10) Patent No.: US 7,968,502 B2
(45) Date of Patent: Jun. 28, 2011

(54) SYSTEM HAVING DLC CONTACT SURFACES, METHOD OF LUBRICATING THE SYSTEM, AND LUBRICANT FOR THE SYSTEM

(75) Inventors: Shozaburo Konishi, Yokohama (JP); Makoto Kano, Yokohama (JP); Takafumi Ueno, Yokohama (JP); Takao Ishikawa, Yokohama (JP)

(73) Assignees: Nippon Oil Corporation, Tokyo (JP); Nissan Motor Co., Ltd., Yokohama (JP)

( * ) Notice: Subject to any disclaimer, the term of this patent is extended or adjusted under 35 U.S.C. 154(b) by 692 days.

(21) Appl. No.: 10/566,915

(22) PCT Filed: Aug. 6, 2004

(86) PCT No.: PCT/JP2004/011377

§ 371 (c)(1),
(2), (4) Date: May 11, 2006

(87) PCT Pub. No.: WO2005/014760

PCT Pub. Date: Feb. 17, 2005

(65) Prior Publication Data

US 2008/0146468 A1 Jun. 19, 2008

(30) Foreign Application Priority Data

| | | |
|---|---|---|
| Aug. 6, 2003 | (JP) | P2003-206197 |
| Aug. 6, 2003 | (JP) | P2003-206199 |
| Aug. 21, 2003 | (JP) | P2003-297683 |
| Aug. 21, 2003 | (JP) | P2003-297684 |
| Aug. 21, 2003 | (JP) | P2003-297685 |
| Aug. 21, 2003 | (JP) | P2003-297687 |

(51) Int. Cl.
*C04B 35/52* (2006.01)
*C10M 169/04* (2006.01)
*C10M 137/10* (2006.01)
*B32B 9/00* (2006.01)

(52) U.S. Cl. ..... 508/109; 508/154; 508/433; 428/408

(58) Field of Classification Search ..... 508/433, 508/109, 154, 179; 428/408
See application file for complete search history.

(56) References Cited

U.S. PATENT DOCUMENTS 5,282,990 A 2/1994 Yoneto et al.

(Continued)

FOREIGN PATENT DOCUMENTS

EP 1167497 1/2002

(Continued)

OTHER PUBLICATIONS

M. Kano et al., The Effect of ZDDP and MODTC Additives on Friction Properties of DLC and Steel CAM Follower in Engine Oil, 2nd World Tribology Congress, Sept. 3-7, 2001, Vienna.

(Continued)

*Primary Examiner* — Glenn A Caldarola
*Assistant Examiner* — Vishal Vasisth
(74) *Attorney, Agent, or Firm* — Jason D. Voight

(57) ABSTRACT

The present invention relates to a lubricant for lubricating relatively movable, facing contact surfaces at least one of which is coated with DLC, a method of lubricating DLC contact surfaces with this lubricant, and a system having DLC contact surfaces. The lubricant fulfills the following conditions (a) and (b):

(a) the lubricant contains a lubricant base oil containing, as a main component, a base oil composed at least one of a hydrocracked mineral oil, a wax-isomerized mineral oil, and a poly-α-olefin base oil. The base oil has a kinematic viscosity of 2 to 20 $mm^2/s$ at 100° C., a total aromatic content of not higher than 5 mass %, and a sulfur content of 0.005 mass %; and (b) the lubricant has a sulfur content of not higher than 0.2 mass %.

10 Claims, 1 Drawing Sheet

U.S. PATENT DOCUMENTS

| | | | | |
|---|---|---|---|---|
| 6,333,298 | B1 | 12/2001 | Waddoups et al. | |
| 6,508,416 | B1 * | 1/2003 | Mastro et al. | 239/585.1 |
| 6,543,394 | B2 * | 4/2003 | Tinney | 123/1 A |
| 2002/0086803 | A1 * | 7/2002 | Berlowitz et al. | 508/371 |
| 2002/0142922 | A1 * | 10/2002 | Yagishita et al. | 508/374 |
| 2003/0162672 | A1 | 8/2003 | Shirahama et al. | |
| 2004/0092405 | A1 | 5/2004 | Konishi et al. | |
| 2004/0242434 | A1 | 12/2004 | Yagishita et al. | |
| 2005/0241216 | A1 * | 11/2005 | Clark et al. | 44/436 |
| 2005/0272616 | A1 * | 12/2005 | Yagishita | 508/460 |

FOREIGN PATENT DOCUMENTS

| | | | | |
|---|---|---|---|---|
| EP | 1535985 | | | 6/2005 |
| JP | 2000-297373 | A | | 10/2000 |
| JP | 2001-192864 | A | | 7/2001 |
| JP | 2001-316686 | A | | 11/2001 |
| JP | 2004-353456 | A | | 12/2004 |
| JP | 2004347053 | A | * | 12/2004 |
| WO | WO-93/21289 | A1 | | 10/1993 |
| WO | WO-03033629 | | | 4/2003 |

OTHER PUBLICATIONS

Japanese Society of Tribologists, Congress Proceeding, Tokyo 1999, 5, p. 11-12, Kano, et al.

PCT International Preliminary Report on Patentability for PCT/JP2004/011377 issued May 8, 2006.

Yukata Mabuchi et al: "Diamond_Like Carbon Coating for Reducing Valvertrain Friction" SAE Technical Paper Series, Society of Automotive Engineers, Warrendale, PA, US, Jan. 1, 2004, XP009105548 ISSN: 0148-7191.

* cited by examiner

SYSTEM HAVING DLC CONTACT SURFACES, METHOD OF LUBRICATING THE SYSTEM, AND LUBRICANT FOR THE SYSTEM

This application is a 371 of PCT/JP04/11377, filed Aug. 6, 2004.

FIELD OF ART

The present invention relates to a system, such as an internal combustion engine, having diamond-like carbon (DLC) contact surfaces, as relatively movable, facing contact surfaces at least one of which is coated with DLC. The present invention also relates to a lubricant for the above system, and a method of lubricating DLC contact surfaces with the lubricant.

BACKGROUND ART

Global environmental issues, such as global warming and ozone depletion, have recently been coming to the front. $CO_2$ emission, in particular, which is said to have a significant impact on global warming, is a considerable concern, and its regulation standards are attracting interest in each country.

One of the major challenges in $CO_2$ reduction is to reduce energy loss caused by friction loss in machinery, systems, and the like, in particular, to reduce vehicle fuel consumption. For reducing friction of parts having relatively movable, facing contact surfaces in engines and the like, such as sliding surfaces, rotating surfaces, or rolling surfaces, an important role is played by materials forming such contact surfaces, and lubricants for lubricating such contact surfaces adapted to each material.

The material forming the contact surfaces is required to give an excellent anti-wear property and a low frictional coefficient to the parts in engines or the like under severe frictional wearing. For these purposes, various hard thin film materials have recently been employed. For example, a DLC material is expected as a low friction material for its lower frictional coefficient in the air in the absence of a lubricant, compared to an anti-wearing hard coating material, such as TiN and CrN.

For reducing energy loss in lubricants, for example, for improving engine fuel consumption, there have been proposed to reduce viscous resistance in hydrodynamic lubrication areas and agitation resistance in engines by lowering the viscosity of lubricants, and to reduce frictional losses in mixed and boundary lubrication areas by adding optimum friction modifiers and various additives. The friction modifiers have widely been researched, in particular, organic molybdenum compounds, such as molybdenum dithiocarbamate (MoDTC) and molybdenum dithiophosphate (MODTP), and lubricants containing organic molybdenum compounds have been developed and achieving effects, which exhibit an excellently low frictional coefficient on conventional steel sliding surfaces in the initial stage of use.

On the other hand, it has been reported that DLC materials, which have an excellent low friction property in the air, can offer only limited friction reducing effect in the presence of a lubricant (Non-patent Publication 1). It has also been reported that application of a lubricant containing an organic molybdenum compound to DLC materials does not result in sufficient friction reducing effect (Non-patent Publication 2).

Non-patent Publication 1: Japanese Society of Tribologists, Congress Proceeding, Tokyo, 1999.5, p 11-12, Kano et al.

Non-patent Publication 2: World Tribology Congress 2001.9, Vienna, Proceeding p 342, Kano et al.

SUMMARY OF THE INVENTION

It is an object of the present invention to provide a system having DLC contact surfaces, wherein friction between relatively movable, facing contact surfaces at least one of which is coated with DLC is further reduced and such low friction property is stably maintained.

It is another object of the present invention to provide a lubricant for a system having DLC contact surfaces, which is suitable for further reducing friction and stably maintaining the low friction property between relatively movable, facing contact surfaces at least one of which is coated with DLC.

It is still another object of the present invention to provide a method of lubricating DLC contact surfaces, which further reduces friction between relatively movable, facing contact surfaces at least one of which is coated with DLC, and lubricates the contact surfaces with stably maintained low friction property.

According to the present invention, there is provided a system having DLC contact surfaces, comprising:

relatively movable, facing contact surfaces at least one of which is coated with DLC, and a lubricant for a system having DLC contact surfaces interposed between said contact surfaces, said lubricant comprising a lubricant base oil (A) containing, as a main component, a base oil (X) consisting at least one of a hydrocracked mineral oil, a wax-isomerized mineral oil, and a poly-α-olefin base oil, wherein said base oil (X) has a kinematic viscosity of 2 to 20 $mm^2/s$ at 100° C., a total aromatic content of not higher than 5 mass %, and a sulfur content of not higher than 0.005 mass %.

According to the present invention, there is also provided a lubricant for a system having DLC contact surfaces, said lubricant being for lubricating relatively movable, facing contact surfaces at least one of which is coated with DLC, said lubricant comprising:

a lubricant base oil (A) containing, as a main component, a base oil (X) consisting at least one of a hydrocracked mineral oil, a wax-isomerized mineral oil, and a poly-α-olefin base oil, wherein said base oil (X) has a kinematic viscosity of 2 to 20 $mm^2/s$ at 100° C., a total aromatic content of not higher than 5 mass %, and a sulfur content of not higher than 0.005 mass %.

According to the present invention, there is also provided a method of lubricating DLC contact surfaces, comprising lubricating relatively movable, facing contact surfaces at least one of which is coated with DLC, with the above lubricant for a system having DLC contact surfaces interposed between said contact surfaces.

The lubricant of the present invention lubricates, at low friction, relatively movable, facing contact surfaces at least one of which is coated with DLC, such as sliding surfaces, rotating surfaces, rolling surfaces, and the like, and also stably maintains such low friction property. Further, both the system and the lubricating method according to the present invention employ the above lubricant of the present invention, so that the system and the method provide wide contribution to energy saving in the fields of various machinery and systems having DLC-coated surfaces and required to have low friction property.

The lubricant, system, and lubricating method according to the present invention may be unlimitedly applied to relatively movable, facing contact surfaces in various machinery and apparatuses required to have low friction property, and provide wide contribution to energy saving in various fields. Further, the lubricant according to the present invention may suitably be applied not only to various machinery and systems having only the relatively movable, facing contact surfaces at least one of which is coated with DLC, but also to various machinery and systems having such contact surfaces adapted to a part of, or a primary part of the sliding surfaces therein, to reduce the friction loss of the entire machinery and systems.

PREFERRED EMBODIMENTS OF THE INVENTION

Figure 1:
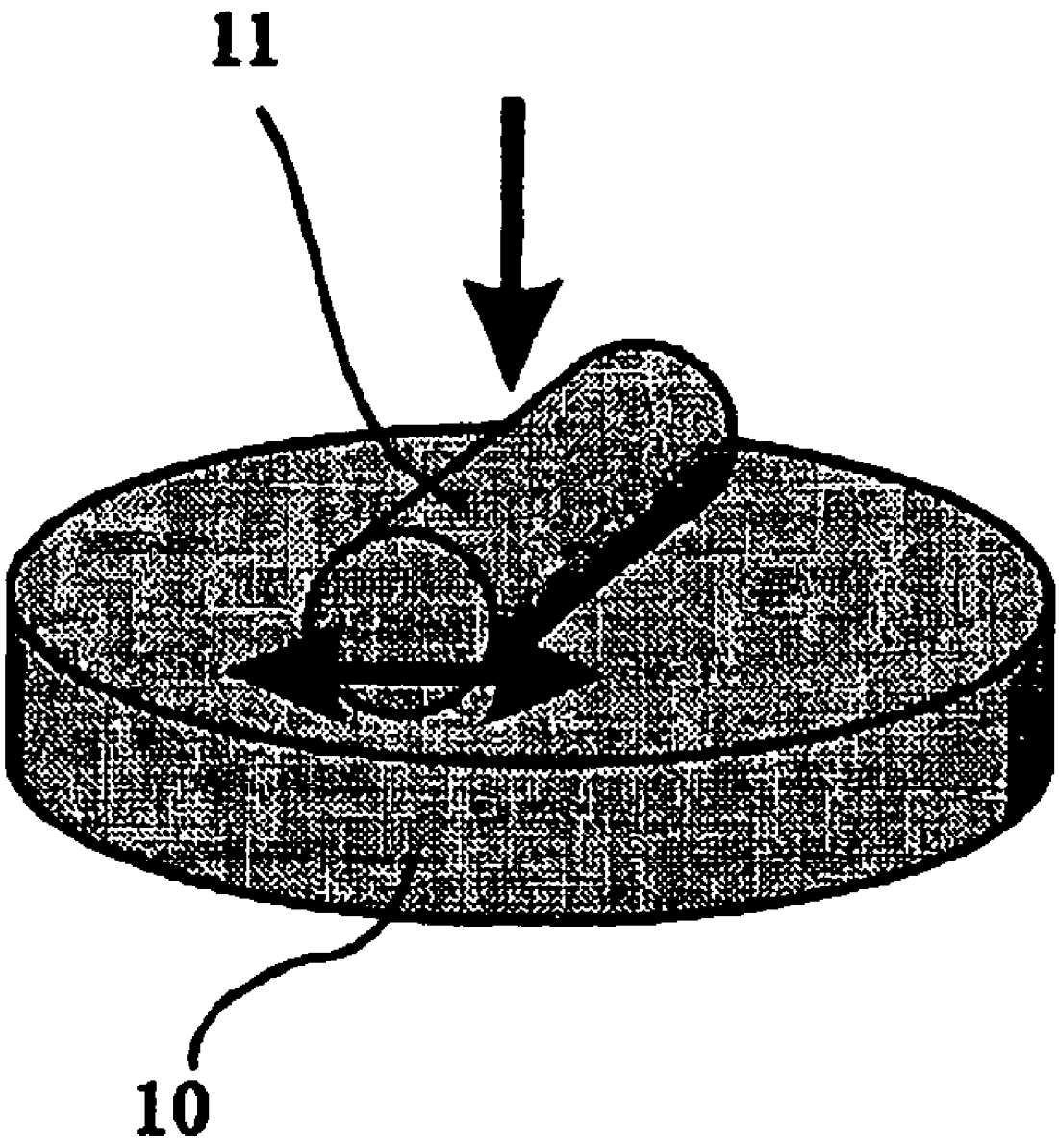
FIG. 1 is a schematic view of test pieces for SRV friction tester prepared in Example.

The present invention will now be explained in detail.

The system according to the present invention has relatively movable, facing contact surfaces at least one of which is coated with DLC. The contact surfaces may have one surface coated with DLC and the other surface made of a metal or non-metal material with or without a coating film thereon of a material other than DLC, or may alternatively have both contact surfaces coated with DLC.

The relatively movable, facing contact surfaces include sliding surfaces, rotating surfaces, rolling surfaces, and the like contact surfaces, wherein one or both of the facing surfaces move to result in relative motion of the surfaces.

The DLC material forming the DLC-coated surface is an amorphous material composed mainly of carbon elements, and includes both carbon bonds in the diamond structure ($SP^3$ bond structure) and in the graphite bond ($SP^2$ bond). Specifically, the DLC material may be a-C (amorphous carbon) consisting solely of carbon elements, a-C:H (hydrogenated amorphous carbon) containing hydrogen, or MeC (metal carbide) having a metal element, such as titanium (Ti) or molybdenum (Mo). The present invention preferably has contact surfaces having at least one surface coated with an a-C based material without hydrogen as the DLC material, for its ability to provide remarkable friction reducing effect.

The material forming the substrate for the DLC-coated surface is not particularly limited, and an iron-based material may preferably be used. The DLC-coated surface may be formed by a conventional PVD or CVD method.

The material forming the substrate for the DLC-coated surface, and the material, in the contact surfaces wherein one is the DLC-coated surface and the other is not, forming such other surface, are not particularly limited. In any case, a metallic material may be used, such as iron-, aluminum-, magnesium-, or titanium-based material. In particular, iron-, aluminum-, and magnesium-based materials are preferred since these materials are conveniently used in relatively movable, facing contact surfaces in existing machinery and systems, and widely contribute to energy saving in various fields. For producing such other surface or the like, a non-metallic material may also be used, such as resins, plastics, or carbons. The surface formed with a metallic or non-metallic material may be coated with a various kinds of thin films of a material other than DLC, such as a TiN or CrN. It is preferred that such a thin film is formed over the surface of a substrate made of a metallic material, such as an iron-, aluminum-, magnesium-, or titanium-based material.

The iron-based material is not particularly limited, and not only iron of high purity, but also various iron-based alloys may be used, wherein carbon, nickel, copper, zinc, chromium, cobalt, molybdenum, lead, silicon, titanium, or two or more kinds of these are arbitrarily combined with iron. Specific examples of the iron-based material may include carburized steel SCM420 and SCr420 (JIS).

The aluminum-based material is not particularly limited, and not only aluminum of high purity, but also various aluminum-based alloys may be used. For example, hypoeutectic or hypereutectic aluminum alloys containing 4 to 20 mass % silicon (Si) and 1.0 to 5.0 mass % copper (Cu) are preferred. Preferred examples of the aluminum alloys may include AC2A, AC8A, ADC12, and ADC14 (JIS).

The magnesium-based material may be, for example, magnesium-aluminum-zinc-based (Mg—Al—Zn), magnesium-aluminum-rare earth metal-based (Mg—Al-REM), magnesium-aluminum-calcium-based (Mg—Al—Ca), magnesium-zinc-aluminum-calcium-based (Mg—Zn—Al—Ca), magnesium-aluminum-calcium-rare earth metal-based (Mg—Al—Ca-REM), magnesium-aluminum-strontium-based (Mg—Al—Sr), magnesium-aluminum-silicon-based (Mg—Al—Si), magnesium-rare earth metal-zinc-based (Mg-REM-Zn), magnesium-silver-rare earth metal-based (Mg—Ag-REM), or magnesium-yttrium-rare earth metal-based (Mg—Y-REM) material, or an arbitrary combination of these materials. Specifically, AZ91, AE42, AX51, AXJ, ZAX85, AXE522, AJ52, AS21, QE22, or WE43 (ASTM) may be used.

The surface roughness (Ra) of the contact surfaces may be measured in accordance with JIS B 0601-1994, and may usually be not more than 0.1 μm, preferably not more than 0.08 μm, for stability of motion of the contact surfaces. If Ra is more than 0.1 μm, local scuffing may occur to remarkably increase the friction coefficient.

The DLC-coated surface or the surface coated with a thin film of a material other than DLC, preferably has a surface hardness of Hv1000 to 3500 in Vickers microhardness (10 g load), and a film thickness of 0.3 to 2.0 μm. If the surface hardness Hv of the thin film, such as of the DLC-coated surface, is less than 1000, or if the film thickness is less than 0.3 μm, the coating is prone to wear out, whereas if the surface hardness Hv is over 3500, or if the film thickness is over 2.0 μm, the coating is prone to flake.

When the iron-based material is used for forming the substrate of the other of the contact surfaces without the DLC-coated surface, the surface hardness is preferably HRC 45 to 60 in Rockwell hardness C scale. This is advantageous for maintaining the durability of the facing DLC-coated surface even in the contact motion under high surface pressure conditions of about 700 MPa, as typically observed with cam follower members. If the surface hardness of the iron-based material is less than HRC45, the facing DLC-coated surface may be prone to buckle and flake under high surface pressure.

When the aluminum-based material is used for forming the substrate of the other of the contact surfaces without the DLC-coated surface, the surface hardness $H_B$ is preferably 80 to 130 in Brinel hardness. If the surface hardness of the aluminum-based material is less than $H_B$ 80, the surface of the aluminum-based material may be prone to wear.

When the magnesium-based material is used for forming the substrate of the other of the contact surfaces without the DLC-coated surface, the surface hardness $H_B$ is preferably 45 to 95 in Brinel hardness. If the surface hardness of the magnesium-based material is less than $H_B$ 45, the surface of the magnesium-based material may be prone to wear.

The lubricant to be used in the system of the present invention may be the lubricant for the system according to the present invention.

The lubricant according to the present invention contains lubricant base oil (A) containing, as a main component, base oil (X) of a particular property, composed of one or more of a hydrocracked mineral oil, a wax-isomerized mineral oil, and a poly-α-olefin base oil, and the lubricant preferably do not contain zinc dithiophosphate and/or a sulfur-containing metal detergent.

The hydrocracked mineral oil used in base oil (X) is not particularly limited as long as the oil has the properties to be discussed later, and may be produced by a conventional method.

The wax-isomerized mineral oil used in base oil (X) is not particularly limited as long as the oil has the properties to be discussed later, and may be produced by isomerizing wax rich in normal paraffin obtained from the dewaxing process of a lubricant, slack wax, or GTL (gas-to-liquid) wax obtained from the Fischer-Tropsch reaction, into isoparaffin by a conventional process. The wax-isomerized mineral oil may also be produced by a suitable combination of optional steps, such as distillation, solvent refining, solvent dewaxing, hydrodewaxing, and hydrorefining.

The poly-α-olefin base oil used in base oil (X) may be polymers or copolymers of C2-C30, preferably C8-C16 α-olefins, or hydrides thereof. Specifically, poly-α-olefins such as 1-octene or 1-decene oligomer, or hydrides thereof, may preferably be used.

The kinematic viscosity of base oil (X) at 100° C. is 2 to 20 $mm^2/s$, preferably 3 to 10 $mm^2/s$, more preferably 3.5 to 5 $mm^2/s$. By setting the kinematic viscosity at 100° C. of base oil (X) to 2 $mm^2/s$ or higher, a lubricant may be obtained which is capable of forming a sufficient oil film, has excellent lubricity, and undergoes lower evaporation loss of the base oil under severe conditions. By setting the kinematic viscosity at 100° C. of base oil (X) to 20 $mm^2/s$ or lower, the fluid resistance of the base oil upon agitation is kept from being too high, and a lubricant exhibiting a low friction resistance on the lubricating site may be obtained.

Base oil (X) has a total aromatic content of not higher than 5 mass %, preferably not higher than 3 mass %, more preferably 0 to 2 mass %. At a reduced total aromatic content, low friction on the DLC-coated surface is achieved and maintained more advantageously.

The total aromatic content as used herein means the content of aromatic fraction measured in accordance with ASTM D2549. The aromatic fraction usually contains alkylbenzene, alkylnaphthalene, anthracene, phenanthrene, and alkylation products thereof; compounds produced by condensation of four or more benzene rings; or compounds having a heteroaromatic ring, such as pyridines, quinolines, phenols, or naphthols.

The sulfur content of base oil (X) is not higher than 0.005 mass %, preferably not higher than 0.002 mass %. Most preferably, base oil (X) is substantially free of sulfur. By reducing the sulfur content of base oil (X), still lower friction on the DLC-coated surface is achieved and maintained more advantageously.

The viscosity index of base oil (X) is not particularly limited, and is usually not lower than 80, preferably not lower than 100, more preferably not lower than 120, most preferably not lower than 125. The upper limit of the viscosity index is usually 200 to 300. By selecting base oil (X) with a high viscosity index, a lubricant having not only excellent viscosity property at low temperatures but also superior friction reducing effect, may be obtained.

Lubricant base oil (A) is most preferably composed solely of base oil (X), but may optionally contain a small amount of other base oils as long as the effects of the present invention are not impaired remarkably, for example, at not more than 30 mass %, preferably not more than 20 mass %, more preferably not more than 10 mass %, of the total amount of lubricant base oil (A).

Such other base oils may be mineral oils that do not have the above properties, hydrocracked oils obtained under mild conditions, synthetic oils other than the poly-α-olefin base oils, or the like. Examples of the mineral oils that do not have the above properties may include solvent refined oils and solvent dewaxed oils. Examples of the synthetic oils other than the poly-α-olefin base oils may include alkylnaphthalene; alkylbenzene; diesters, such as ditridecyl glutarate, dioctyl adipate, diisodecyl adipate, ditridecyl adipate, and dioctyl sebacate; polyol esters, such as trimethylolpropane caprylate, trimethylolpropane pelargonate, pentaerythritol-2-ethylhexanoate, and pentaerythritol pelargonate; and mixtures of two or more of these.

The lubricant of the present invention may optionally contain, in addition to lubricant base oil (A), additives, for example, selected from the group consisting of a sulfur-free metal detergent (B), a sulfur-free phosphorus compound (C), a sulfur-free ashless anti-oxidant (D), and mixtures of two or more of these, as long as the effects of the present invention are not impaired, or for improving the effects of the present invention and other effects.

Component (B) may be, for example, alkali metal or alkaline earth metal salicylates, alkali metal or alkaline earth metal phenates (without sulfur cross-linking, and limited to those crosslinked with, for example, alkylene groups), or alkali metal or alkaline earth metal carboxylates. The alkali metal may be sodium, potassium, or the like, and the alkaline earth metal may be calcium, magnesium, barium, or the like. The metal in the metal detergent is preferably alkaline earth metal, in particular calcium.

Component (B) may be neutral, basic, or overbased, and any of these may be used. Neutral alkaline earth metal salicylate has particularly excellent friction reducing effect. Basic or overbased metal detergent may be, for example, a metal detergent containing calcium carbonate and/or calcium borate, and any of these may be used. However, alkaline earth metal salicylate containing calcium borate, in particular, alkaline earth metal salicylate containing calcium borate and not containing calcium carbonate, is particularly preferred for its excellent practical friction reducing effect.

The total base number of component (B) is not particularly limited, and is usually 10 to 400 mgKOH/g, preferably 60 to 350 mgKOH/g. It is preferred to use either or both of components (B) of 60 to 150 mgKOH/g and 150 to 350 mgKOH/g.

In general, when a lubricant is deteriorated to form sludge or the like, the lubricating conditions on the DLC contact surfaces are impaired, and the friction tends to increase. However, it is believed that, by addition of component (B), the sludge or the like generated in the lubricant is dispersed in the oil, which prevents degradation of the lubricating conditions and maintains the friction reducing effect. In addition, component (B) also prevents deterioration of the lubricant per se, resulting in maintenance of the friction reducing effect.

Thus, in order to further improve such effects, and for improving detergency, it is preferred to add component (B) as required. The content of component (B), if any, is not particularly limited. For use in internal combustion engines, the content in terms of metal elements, is preferably 0.01 to 1 mass %, more preferably 0.05 to 0.3 mass % of the total amount of the lubricant, and most preferably not more than 0.2 mass % for lowering sulfated ash.

The lubricant of the present invention may optionally contain a small amount of a metal detergent other than component (B) as long as the effects of the present invention are not impaired remarkably.

Component (C), a sulfur-free phosphorus compound, is a phosphorus compound having no sulfur in its molecule. Examples of the compound may include phosphorus compounds having no sulfur, such as phosphite monoesters, phosphite diesters, phosphite triesters, phosphate monoesters, phosphate diesters, and phosphate triesters, each having a C1-C30 hydrocarbon group, metal salts thereof, and amine salts thereof.

The C1-C30 hydrocarbon group may preferably be a straight or branched C1-C30 alkyl group, a straight or branched C1-C30 alkenyl group, a C5-C13 cycloalkyl or straight or branched alkylcycloalkyl group, a C6-C18 aryl or straight or branched alkylaryl group, or a C7-C19 arylalkyl group. The alkyl or alkenyl group may either be primary, secondary, or tertiary.

Specific examples of the C1-C30 hydrocarbon group may include alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, docosyl, tricosyl, and tetracosyl groups; alkenyl groups, such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, such as oleyl, nonadecenyl, icosenyl, henicosenyl, docosenyl, tricosenyl, and tetracosenyl groups; cycloalkyl groups, such as cyclopentyl, cyclohexyl, and cycloheptyl groups; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, dipropylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, dipropylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, dipropylcycloheptyl, and propylethylmethylcycloheptyl groups; aryl groups, such as phenyl and naphthyl groups; alkylaryl groups, such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl, and dodecylphenyl groups; arylalkyl groups, such as benzyl, methylbenzyl, dimethylbenzyl, phenethyl, methylphenethyl, and dimethylphenethyl groups.

The hydrocarbon group includes all conceivable straight and branched structures, and the position of the double bond in an alkenyl group, the position of an alkyl group bonded to a cycloalkyl group, the position of an alkyl group bonded to an aryl group, and the position of an aryl group bonded to an alkyl group, are all arbitrary. Further, the hydrocarbon group may have a (poly) alkylene oxide, such as (poly)ethylene oxide or (poly)propylene oxide.

Preferred examples of component (C) may include phosphite monoesters, phosphite diesters, phosphite triesters, phosphate monoesters, phosphate diesters, and phosphate triesters, each having a C3-C24, preferably C4-C18, more preferably C4-C12, primary, secondary, or tertiary alkyl group; metal salts thereof; and amine salts thereof. Among these, phosphate esters, metal salts thereof, and amine salts thereof are preferred, and metal salts and amine salts (amine complexes) of phosphate monoesters and/or phosphate diesters are particularly preferred.

The metal in the metal salt is not particularly limited, and may be, for example, an alkali metal, such as lithium, sodium, potassium, or cesium; an alkaline earth metal, such as calcium, magnesium, or barium; or a heavy metal, such as zinc, copper, iron, lead, nickel, silver, manganese, or molybdenum. Among these, alkaline earth metals, such as calcium and magnesium, and zinc are preferred, and zinc is most preferred.

The amine in the amine salt is not particularly limited, and may be, for example, ammonia, monoamine, diamine, or polyamine. Specific examples may include alkylamines having a C1-C30 alkyl group (either straight or branched), such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a C2-C30 alkenyl group (either straight or branched), such as ethenylamine, propenylamine, butenylamine, octenylamine, and oleylamine; alkanolamines having a C1-C30 alkanol group (either straight or branched), such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having a C1-C30 alkylene group, such as methylenediamine, ethylenediamine, propylenediamine, and butylenediamine; polyamines, such as diethylenetriamine, triethylenetetramine, tetraethylenepentamine, and pentaethylenehexamine; heterocyclic compounds including the above-mentioned monoamines, diamines, polyamines having a C8-C20 alkyl or alkenyl group, such as undecyldiethylamine, undecyldiethanolamine, dodecyldipropanolamine, oleyldiethanolamine, oleylpropylenediamine, and stearyltetraethylenepentamine, and N-hydroxyethyloleylimidazoline; alkylene oxide addition products thereof; mixtures thereof; and compounds, such as alkyl or alkenyl succinimides.

Among these amine compounds, aliphatic amines (either straight or branched) having a C10-C20 alkyl or alkenyl group, such as decylamine, dodecylamine, tridecylamine, heptadecylamine, octadecylamine, oleylamine, and stearylamine, are preferred.

It is believed that component (C) in the lubricant of the present invention inhibits degradation of lubricating conditions due to deterioration products generated by lubricant deterioration, prevents increase in friction, and maintains the low friction property of the lubricant more advantageously. Thus, for further improving such effects, and for improving the anti-wear property, it is preferred to contain component (C) as desired. The content of component (C) is not particularly limited, and is usually 0.1 to 5 mass % of the total amount of the lubricant. When the lubricant of the present invention is to be used in an internal combustion engine, the content of component (C) is preferably 0.01 to 0.1 mass %, preferably not more than 0.08 mass %, most preferably not more than 0.06 mass % of the total amount of the lubricant in terms of phosphorus elements, in view of the impact on exhaust gas post-treatment systems.

Component (D), a sulfur-free ashless anti-oxidant, is an ashless anti-oxidant having no sulfur atom in its molecule, and may be, for example, a sulfur-free phenol anti-oxidant or a sulfur-free amine anti-oxidant. Use of a sulfur-containing ashless anti-oxidant may have negative impact on the achievement and maintenance of low friction between the relatively movable, facing contact surfaces at least one of which is coated with DLC.

Examples of the sulfur-free phenol anti-oxidant as component (D) may include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol), 2,6-di-tert-butyl-4-ethylphenol, 2,4-dimethyl-6-tert-butylphenol, 2,6-di-tert-α-dimethylamino-p-cresol, 2,6-di-tert-butyl-4 (N,N'-dimethylaminomethylphenol), tridecyl-3-(3,5-di-tert-butyl-4-hydroxyphenyl) propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, and 3-methyl-5-tert-butyl-4-hydroxyphenyl substituted aliphatic esters. A mixture of two or more of these may be used.

Examples of the sulfur-free amine anti-oxidant as component (D) may include phenyl-α-naphthylamine, alkylphenyl-α-naphthylamine, and dialkyldiphenylamine. A mixture of two or more of these may be used.

The phenol anti-oxidant and the amine anti-oxidant may be used in combination.

It is believed that component (D) inhibits degradation of lubricating conditions due to sludge or the like generated by lubricant deterioration, and prevents increase in friction, so that component (D) improves sustainability of the friction reducing effect of the lubricant. Thus, for further improving such effects, and for improving oxidation stability, it is preferred to contain component (D) as desired. The content of component (D), if any, is usually 0.01 to 5 mass %, preferably 0.1 to 3 mass %, more preferably 0.5 to 2 mass % of the total amount of the lubricant.

The lubricant of the present invention may optionally contain a friction modifier. The friction modifier may be, for example, an oxygen-containing organic compound or amines. Also preferred is at least one of C1-C40 esters, amines, amides, alcohols, ethers, carboxylic acids, ketones, aldehydes, and carbonates, and derivatives thereof. Among these, at least one of, or a mixture of two or more of C3-C30, preferably C3-C20 aliphatic esters, aliphatic amines, aliphatic amides, aliphatic alcohols, and aliphatic carboxylic acids, and derivatives thereof, is preferred.

The oxygen-containing organic compound may be any organic compound as long as it has oxygen in its molecule, and may be a compound composed of carbon, hydrogen, and oxygen, or a compound having, in addition to these elements, halogen, such as fluorine or chlorine, nitrogen, sulfur, phosphorus, boron, metal, or the like, in its molecule.

Examples of the oxygen-containing organic compound may include oxygen-containing organic compounds having at, least one of a hydroxyl group, a carboxyl group, a carbonyl group, an ester bond, and an ether bond, and derivatives thereof. Among these, preferred compounds are oxygen-containing organic compounds having at least one of a hydroxyl group, a carboxyl group, a carbonyl group, and an ester bond, and derivatives thereof; more preferred compounds are oxygen-containing organic compounds having at least one of a hydroxyl group, a carboxyl group, and an ester bond, and derivatives thereof; and most preferred compounds are oxygen-containing organic compounds having at least one of a hydroxyl group and a carboxyl group, and derivatives thereof. In particular, oxygen-containing organic compounds having a hydroxyl group, and derivatives thereof are particularly preferred for their ability to further reduce friction between the DLC contact surfaces. It is preferred that these compounds have two or more hydroxyl groups. It is also preferred that the oxygen-containing organic compounds contain little or no sulfur.

The above-mentioned derivatives may typically be a compound obtained by reacting the compound composed of carbon, hydrogen, and oxygen, with, for example, a nitrogen-containing compound, a phosphorus-containing compound, sulfur, a sulfur containing compound, a boron-containing compound, halogen, a halogen-containing compound, metal, an inorganic or organic metal-containing compound, or alkylene oxide.

Examples of the oxygen-containing organic compound may include oxygen-containing compounds, such as alcohols, carboxylic acids, esters, ethers, ketones, aldehydes, and carbonates, and these compounds further having at least one of a hydroxyl group, a carboxyl group, a carbonyl group, and an ester bond bonded thereto, derivatives thereof, and mixtures of two or more of these.

The alcohols may be, for example, monohydric, dihydric, trihydric or higher alcohols, or mixtures of two or more of these.

The monohydric alcohol has one hydroxyl group in its molecule, and may be, for example, C1-C40 monohydric alkyl alcohol having a straight or branched alkyl group, C2-C40 monohydric alkenyl alcohol having a straight or branched alkenyl group with the double bond at an arbitrary position, C3-C40 monohydric (alkyl)cycloalkyl alcohol having a straight or branched alkyl group with alkyl and hydroxyl groups substituted at arbitrary positions, (alkyl)aryl alcohol having a straight or branched alkyl group with alkyl and hydroxyl groups substituted at arbitrary positions, 6-(4-oxy-3,5-di-tert-butylanilino)-2,4-bis(n-octylthio)-1,3,5-triazine, or a mixture of two or more of these.

Examples of the monohydric alkyl alcohols may include methanol; ethanol; propanol, such as 1-propanol and 2-propanol; butanol, such as 1-butanol, 2-butanol, 2-methyl-1-propanol, and 2-methyl-2-propanol; pentanol, such as 1-pentanol, 2-pentanol, 3-pentanol, 2-methyl-1-butanol, 3-methyl-1-butanol, 3-methyl-2-butanol, 2-methyl-2-butanol, and 2,2-dimethyl-1-propanol; hexanol, such as 1-hexanol, 2-hexanol, 3-hexanol, 2-methyl-1-pentanol, 2-methyl-2-pentanol, 2-methyl-3-pentanol, 3-methyl-1-pentanol, 3-methyl-2-pentanol, 3-methyl-3-pentanol, 4-methyl-1-pentanol, 4-methyl-1-pentanol, 4-methyl-2-pentanol, 2,3-dimethyl-2-butanol, 3,3-dimethyl-1-butanol, 3,3-dimethyl-2-butanol, 2-ethyl-1-butanol, and 2,2-dimethylbutanol; heptanol, such as 1-heptanol, 2-heptanol, 3-heptanol, 2-methyl-1-hexanol, 2-methyl-1-hexanol, 2-methyl-2-hexanol, 2-methyl-3-hexanol, 5-methyl-2-hexanol, 3-ethyl-3-pentanol, 2,2-dimethyl-3-pentanol, 2,3-dimethyl-3-pentanol, 2,4-dimethyl-3-pentanol, 4,4-dimethyl-2-pentanol, 3-methyl-1-hexanol, 4-methyl-1-hexanol, 5-methyl-1-hexanol, and 2-ethylpentanol; octanol, such as 1-octanol, 2-octanol, 3-octanol, 4-methyl-3-heptanol, 6-methyl-2-heptanol, 2-ethyl-1-hexanol, 2-propyl-1-pentanol, 2,4,4-trimethyl-1-pentanol, 3,5-dimethyl-1-hexanol, 2-methyl-1-heptanol, and 2,2-dimethyl-1-hexanol; nonanol, such as 1-nonanol, 2-nonanol, 3,5,5-trimethyl-1-hexanol, 2,6-dimethyl-4-heptanol, 3-ethyl-2,2-dimethyl-3-pentanol, and 5-methyloctanol; decanol, such as 1-decanol, 2-decanol, 4-decanol, 3,7-dimethyl-1-octanol, and 2,4,6-trimethylheptanol; undecanol; dodecanol; tridecanol; tetradecanol; pentadecanol; hexadecanol; heptadecanol; octadecanol, such as stearyl alcohol; nonadecanol; eicosanol; heneicosanol; tricosanol; and tetracosanol.

Examples of the monohydric alkenyl alcohols may include ethenol, propenol, butenol, hexenol, octenol, decenol, dodecenol, or octadecenol, such as oleyl alcohol.

Examples of the monohydric (alkyl)cycloalkyl alcohols may include cyclopentanol, cyclohexanol, cycloheptanol, methylcyclopentanol, methylcyclohexanol, butylcyclohexanol, dimethylcyclohexanol, cyclopentylmethanol, cyclohexylmethanol, cyclohexylethanol, such as 1-cyclohexylethanol and 2-cyclohexylethanol, cyclohexylpropanol, such as 3-cyclohexylpropanol, cyclohexylbutanol, such as 4-cyclohexylbutanol, butylcyclohexanol, and 3,3,5,5-tetramethylcyclohexanol.

Examples of the (alkyl)aryl alcohol may include phenyl alcohol, methylphenyl alcohol, such as o-cresol, m-cresol, and p-cresol, creosol, ethylphenyl alcohol, propylphenyl alcohol, butylphenyl alcohol, butylmethylphenyl alcohol, such as 3-methyl-6-tert-butylphenyl alcohol, dimethylphenyl alcohol, diethylphenyl alcohol, dibutylphenyl alcohol, such as 2,6-di-tert-butylphenyl alcohol and 2,4-di-tert-butylphenyl alcohol, dibutylmethylphenyl alcohol, such as 2,6-di-tert-butyl-4-methylphenyl alcohol, dibutylethylphenyl alcohol, such as 2,6-di-tert-butyl-4-ethylphenyl alcohol, tributylphenyl alcohol, such as 2,4,6-tri-tert-butyl-4-butylphenyl alcohol, naphthol, such as α-naphthol and β-naphthol, and dibutylnaphthol, such as 2,4-di-tert-butyl-α-naphthol.

The monohydric alcohols may preferably be straight or branched C12-C18 alkyl alcohols, such as oleyl alcohol or stearyl alcohol, for enhanced reduction in friction between the DLC contact surfaces, and for low volatility and achievement of friction reducing effect even under high temperature conditions, for example, in engines.

The dihydric alcohol has two hydroxyl groups in its molecule, and may be, for example, C2-C40 alkyl- or alkenyldiol having a straight or branched alkyl or alkenyl group with the double bond in the alkenyl group at an arbitrary position; (alkyl)cycloalkanediol having a straight or branched alkyl group with alkyl and hydroxyl groups substituted at arbitrary positions; C2-C40 dihydric (alkyl)aryl alcohol having a straight or branched alkyl group with alkyl and hydroxyl groups substituted at arbitrary positions; a condensate of p-tert-butylphenol and formaldehyde; a condensate of p-tert-butylphenol and acetaldehyde; and a mixture of two or more of these.

Examples of the alkyl- or alkenyldiol may include ethylene glycol, diethylene glycol, polyethylene glycol, propylene glycol, dipropylene glycol, polypropylene glycol, neopentyl glycol, 1,3-propanediol, 1,4-butanediol, 1,2-butanediol, 2-methyl-1,3-propanediol, 1,5-pentanediol, 1,6-hexanediol, 2-ethyl-2-methyl-1,3-propanediol, 2-methyl-2,4-pentanediol, 1,7-heptanediol, 2-methyl-2-propyl-1,3-propanediol, 2,2-diethyl-1,3-propanediol, 1,8-octanediol, 1,9-nonanediol, 2-butyl-2-ethyl-1,3-propanediol, 1,10-decanediol, 1,11-undecanediol, 1,12-dodecanediol, 1,13-tridecanediol, 1,14-tetradecanediol, 1,15-heptadecanediol, 1,16-hexadecanediol, 1,17-heptadecanediol, 1,18-octadecanediol, 1,19-nonadecanediol, and 1,20-icosadecanediol.

Examples of the (alkyl)cycloalkanediol may include cyclohexanediol and methylcyclohexanediol.

Examples of the dihydric (alkyl)aryl alcohol may include benzenediol, such as catechol; methylbenzenediol; ethylbenzenediol; butylbenzenediol, such as p-tert-butylcatechol; dibutylbenzenediol, such as 4,6-di-tert-butyl resorcin; 4,4'-thiobis(3-methyl-6-tert-butylphenol), 4,4'-butylidenebis(3-methyl-6-tert-butylphenol), 2,2'-methylenebis(4-methyl-6-tert-butylphenol), 2,2'-thiobis(4,6-di-tert-butyl resorcin), 2,2'-methylene-bis(4-ethyl-6-tert-butylphenol), 4,4'-methylenebis(2,6-di-tert-butylphenol), 2,2'-(3,5-di-tert-butyl-4-hydroxy)propane, and 4,4'-cyclohexylidenebis(2,6-di-tert-butylphenol).

The dihydric alcohol may preferably be ethyleneglycol, neopentyl glycol, 1,6-hexanediol, 2-methyl-2,4-pentanediol, 2-ethyl-2-methyl-1,3-propanediol, 1,7-heptanediol, 1,8-octanediol, 1,9-nonanediol, 1,10-decanediol, 1,11-undecanediol, or 1,12-dodecanediol, for enhanced reduction in friction between the DLC contact surfaces. Hindered alcohols having a high molecular weight of not lower than 300, preferably not lower than 400, such as 2,6-di-tert-butyl-4-(3,5-di-tert-butyl-4-(3,5-di-tert-butyl-4-hydroxybenzyl)phenyl alcohol, are preferred for their low volatility, excellent heat resistance, and ability to exhibit friction reducing effect, even under high temperature conditions in engines or the like, and for their ability to give superior oxidation stability.

The trihydric or higher alcohol has three or more hydroxyl groups in its molecule, and usually trihydric to decahydric alcohols, preferably trihydric to hexahydric alcohols are used. Examples of these polyhydric alcohols may include glycerin; trimethylolalkane, such as trimethylolethane, trimethylolpropane, and trimethylolbutane; erythritol; pentaerythritol; 1,2,4-butanetriol; 1,3,5-pentanetriol; 1,2,6-hexanetriol; 1,2,3,4-butanetetrol; sorbitol; adonitol; arabitol; xylitol; mannitol; and polymers or condensates thereof.

Examples of the polymers or condensates may include dimers to octamers of glycerin, such as diglycerin, triglycerin, and tetraglycerin; dimers to octamers of trimethylolpropane, such as ditrimethylolpropane; dimers to tetramers of pentaerythritol, such as dipentaerythritol; sorbitan; intramolecular condensation compounds, such as sorbitol-glycerin condensation products; intermolecular condensation compounds; or self-condensation compounds.

As the trihydric or higher alcohols, sugars may also be used, such as xylose, arabitol, ribose, rhamnose, glucose, fructose, mannose, sorbose, cellobiose, mantose, isomaltose, trehalose, or sucrose.

The trihydric or higher alcohols may preferably be trihydric to hexahydric alcohols, such as glycerin; trimethylolalkane, including trimethylolethane, trimethylolpropane, and trimethylolbutane; pentaerythritol; 1,2,4-butanetriol; 1,3,5-pentanetriol; 1,2,6-hexanetriol; 1,2,3,4-butanetetrol; sorbitol; sorbitan; sorbitol-glycerin condensation products; adonitol; arabitol; xylitol; or mannitol; or mixtures thereof. Among these, glycerin, trimethylolethane, trimethylolpropane, pentaerythritol, sorbitan, and mixtures thereof are more preferred, and polyhydric alcohols having an oxygen content of not less than 20%, preferably not less than 30%, more preferably not less than 40%, are particularly preferred. Incidentally, polyhydric alcohols higher than hexahydric alcohols increase viscosity.

The carboxylic acids may be compounds having one or more carboxyl groups, such as aliphatic monocarboxylic acids, aliphatic polycarboxylic acids, carbocyclic carboxylic acids, heterocyclic carboxylic acids, or mixtures of two or more of these.

Examples of the aliphatic monocarboxylic acids may include C1-C40 saturated aliphatic monocarboxylic acids having a straight or branched saturated aliphatic group, and C2-C40 unsaturated aliphatic monocarboxylic acids having a straight or branched unsaturated aliphatic group, with an unsaturated bond at an arbitrary position.

Examples of the saturated aliphatic monocarboxylic acids may include methanoic acid; ethanoic acid (acetic acid); propanoic acid (propionic acid); butanoic acid, such as butyric acid and isobutyric acid; pentanoic acid, such as valeric acid, isovaleric acid, and pivalic acid; hexanoic acid, such as capronic acid; heptanoic acid; octanoic acid, such as caprylic acid; nonanoic acid, such as pelargonic acid; decanoic acid; undecanoic acid; dodecanoic acid, such as lauric acid; tridecanoic acid; tetradecanoic acid, such as myristic acid; pentadecanoic acid; hexadecanoic acid, such as palmitic acid; heptadecanoic acid; octadecanoic acid, such as stearic acid; nonadecanoic acid; icosanoic acid; henicosanoic acid; docosanoic acid; tricosanoic acid; tetracosanoic acid; pentacosanoic acid; hexacosanoic acid; heptacosanoic acid; octacosanoic acid; nonacosanoic acid; and triacontanoic acid.

Examples of the unsaturated aliphatic monocarboxylic acids may include propenoic acid, such as acrylic acid; propionic acid, such as propiolic acid; butenoic acid, such as methacrylic acid, crotonic acid, and isocrotonic acid; pentenoic acid; hexenoic acid; heptenoic acid; octenoic acid; nonenoic acid; decenoic acid; undecenoic acid; dodecenoic acid; tridecenoic acid; tetradecenoic acid; pentadecenoic acid; hexadecenoic acid; heptadecenoic acid; octadecenoic acid, such as oleic acid; nonadecenoic acid; icosenoic acid; henicosenoic acid; docosenoic acid; tricosenoic acid; tetracosenoic acid; pentacosenoic acid; hexacosenoic acid; heptacosenoic acid; octacosenoic acid; nonacosenoic acid; and triacontenoic acid.

Examples of the aliphatic polycarboxylic acid may include C2-C40 saturated or unsaturated aliphatic dicarboxylic acids having a straight or branched saturated or unsaturated aliphatic group with an unsaturated bond at an arbitrary position, saturated or unsaturated aliphatic tricarboxylic acids having a straight or branched saturated or unsaturated aliphatic group with an unsaturated bond at an arbitrary position, and saturated or unsaturated aliphatic tetracarboxylic acids having a straight or branched saturated or unsaturated aliphatic group with an unsaturated bond at an arbitrary position.

Examples of the aliphatic dicarboxylic acid may include ethanedioic acid (oxalic acid); propanedioic acid, such as malonic acid; butanedioic acid, such as succinic acid and methylmalonic acid; pentanedioic acid, such as glutanic acid and ethylmalonic acid; hexanedioic acid, such as adipic acid; heptanedioic acid, such as pimelic acid; octanedioic acid, such as spelic acid; nonanedioic acid, such as azelaic acid; decanedioic acid, such as sebacic acid; propenedioic acid; butenedioic acid, such as maleic acid and fumaric acid; pentenedioic acid, such as citraconic acid and mesaconic acid; hexenedioic acid; heptenedioic acid; octenedioic acid; nonenedioic acid; and decenedioic acid.

Examples of the aliphatic tricarboxylic acid may include propanetricarboxylic acid, butanetricarboxylic acid, pentanetricarboxylic acid, hexanetricarboxylic acid, heptanetricarboxylic acid, octanetricarboxylic acid, nonanetricarboxylic acid, and decanetricarboxylic acid.

The carbocyclic carboxylic acids may be C3-C40 mono-, di-, tri-, or tetracarboxylic acids having a naphthene ring, wherein alkyl and alkenyl groups, if contained, may be straight or branched, the position of a double bond is arbitrary, and the number and position of substitution are arbitrary; or C7-C40 mono-, di-, tri-, or tetracarboxylic acids having an aryl group, such as C7-C40 aromatic monocarboxylic acids, wherein alkyl and alkenyl groups, if contained, may be straight or branched, the position of a double bond is arbitrary, and the number and position of substitution are arbitrary.

Examples of the mono-, di-, tri-, or tetracarboxylic acid having a naphthene ring may include cyclohexane monocarboxylic acid, methylcyclohexane monocarboxylic acid, ethylcyclohexane monocarboxylic acid, propylcyclohexane monocarboxylic acid, butylcyclohexane monocarboxylic acid, pentylcyclohexane monocarboxylic acid, hexylcyclohexane monocarboxylic acid, heptylcyclohexane monocarboxylic acid, octylcyclohexane monocarboxylic acid, cycloheptane monocarboxylic acid, cyclooctane monocarboxylic acid, and trimethylcyclopentane dicarboxylic acid, such as camphoric acid.

Examples of the mono-, di-, tri-, or tetracarboxylic acid having an aryl group may include benzenecarboxylic acid (benzoic acid); methylbenzenecarboxylic acid, such as toluic acid; ethylbenzenecarboxylic acid; propylbenzenecarboxylic acid; benzenedicarboxylic acid, such as phthalic acid, isophthalic acid, and terephthalic acid; benzenetricarboxylic acid, such as trimellitic acid; benzenetetracarboxylic acid, such as pyromellitic acid; naphthalenecarboxylic acid, such as naphthoic acid; phenylpropanic acid, such as hydratropic acid; phenylpropenic acid, such as atropic acid and cinnamic acid; salicylic acid; and alkylsalicylic acid having one or more C1-C30 alkyl groups.

The heterocyclic carboxylic acids have one or more carboxyl groups in its molecule, and may be, for example, C5-C40 heterocyclic carboxylic acids, such as furancarboxylic acid, thiophenecarboxylic acid, pyridine carboxylic acid, including nicotinic acid and isonicotinic acid.

The esters are oxygen-containing organic compounds having one or more ester bonds, and may be, for example, esters of aliphatic monocarboxylic acids, esters of aliphatic polycarboxylic acids, esters of carbocyclic carboxylic acids, esters of heterocyclic carboxylic acids, or mixtures of two or more of these. The esters may be complete esters wherein all the hydroxyl or carboxyl groups in the esters are esterified, or partial esters wherein some of the hydroxyl or carboxyl groups remain intact.

The esters of aliphatic monocarboxylic acids may be esters of one or more compounds selected from the group consisting of the aliphatic monocarboxylic acids mentioned above, and one or more compounds selected from the group consisting of the mono-, di-, or trihydric, or higher alcohols mentioned above. Preferred examples of such esters may include glycerin monooleate, glycerin dioleate, glycerin trioleate, sorbitan monooleate, and sorbitan dioleate.

The esters of aliphatic polycarboxylic acids may be esters of one or more compounds selected from the group consisting of the aliphatic polycarboxylic acids mentioned above, and one or more compounds selected from the group consisting of the mono-, di-, or trihydric, or higher alcohols mentioned above. Preferred examples of such esters may include diesters of one or more polycarboxylic acids selected from the group consisting of C2-C40, preferably C4-C18, more preferably C6-C12 dicarboxylic acids, and one or more compounds selected from the group consisting of C4-C40, preferably C4-C18, more preferably C6-C14 monohydric alcohols, such as, dibutyl maleate, ditridecyl glutarate, di-2-ethylhexyl adipate, diisodecyl adipate, ditridecyl adipate, or di-2-ethylhexyl sebacate; copolymers of these diesters, such as dibutyl maleate, and C4-C16 poly-α-olefins; and esters of α-olefin-acetic anhydride addition products and C1-C40 alcohols.

The esters of carbocyclic carboxylic acids may be esters of one or more compounds selected from the group consisting of the carbocyclic carboxylic acids mentioned above, and one or more compounds selected from the group consisting of the mono-, di-, or trihydric, or higher alcohols mentioned above. Preferred examples of such esters may include aromatic carboxylic esters, such as phthalic esters, trimellitic esters, pyromellitic esters, and salicylic esters.

The esters of heterocyclic carboxylic acids may be esters of one or more compounds selected from the group consisting of the heterocyclic carboxylic acids mentioned above, and one or more compounds selected from the group consisting of the mono-, di-, or trihydric, or higher alcohols mentioned above.

The ethers are oxygen-containing organic compounds having one or more ether bonds, and may be saturated or unsaturated aliphatic ethers, aromatic ethers, cyclic ethers, ethers of polyhydric alcohols, and mixtures of two or more of these.

Examples of the saturated or unsaturated aliphatic ethers may include C1-C40 saturated or unsaturated aliphatic ethers, such as dimethyl ether, diethyl ether, di-n-propyl ether, diisopropyl ether, dibutyl ether, diisobutyl ether, di-n-amyl ether, dihexyl ether, diheptyl ether, dioctyl ether, dinonyl ether, didecyl ether, diundecyl ether, didodecyl ether, ditridecyl ether, ditetradecyl ether, dipentadecyl ether, dihexadecyl ether, diheptadecyl ether, dioctadecyl ether, dinonadecyl ether, diicosyl ether, methylethyl ether, methyl-n-propyl ether, methylisopropyl ether, methylisobutyl ether, methyl-tert-butyl ether, methyl-n-amyl ether, methylisoamyl ether, ethyl-n-propyl ether, ethylisopropyl ether, ethylisobutyl ether, ethyl-tert-butyl ether, ethyl-n-amyl ether, ethylisoamyl ether, divinyl ether, diallyl ether, methylvinyl ether, methylallyl ether, ethylvinyl ether, and ethylallyl ether. These saturated or unsaturated aliphatic group may either be straight or branched, and the position of an unsaturated bond may be arbitrary.

Examples of the aromatic ethers may include anisole, phenetole, phenyl ether, benzyl ether, phenylbenzyl ether, α-naphthyl ether, β-naphthyl ether, polyphenyl ether, and perfluoro ether. These compounds may have a straight or branched, saturated or unsaturated aliphatic group, the position of an unsaturated bond is arbitrary, and the position and number of substitution are arbitrary. These compounds are preferably in the liquid form upon use, preferably in the liquid form at room temperature.

Examples of the cyclic ethers may include C2-C40 cyclic ethers, such as ethylene oxide, propylene oxide, trimethylene oxide, tetrahydrofuran, tetrahydropyran, dioxane, and glycidyl ether. These compounds may have a straight or branched, saturated or unsaturated aliphatic group, a carbocyclic ring, or a carbocyclic ring having a saturated or unsaturated aliphatic group, the position of an unsaturated bond is arbitrary, and the position and number of substitution are arbitrary.

The ethers of polyhydric alcohols are ethers of one or more polyhydric alcohols selected from the group consisting of the dihydric, trihydric, or higher alcohols mentioned above, and one or more monohydric alcohols selected from the group consisting of the monohydric alcohols mentioned above. The ethers may be complete ethers wherein all the hydroxyl groups in the polyhydric alcohol are etherified, or partial ethers wherein some of the hydroxyl groups remain intact. For giving lower friction property, partial ethers are more preferred.

The ketones are oxygen-containing organic compounds having one or more carbonyl bonds, and may be saturated or unsaturated aliphatic ketones, carbocyclic ketones, heterocyclic ketones, ketone alcohols, ketonic acids, or mixtures of two or more of these.

Examples of the saturated or unsaturated aliphatic ketones may include C1-C40 saturated or unsaturated aliphatic ketones, such as acetone, methylethyl ketone, methylpropyl ketone, methylisopropyl ketone, methylbutyl ketone, methylisobutyl ketone, pinacolone, diethyl ketone, butyrone, diisopropyl ketone, methylvinyl ketone, mesityl oxide, and methylbutenone. These compounds may have a straight or branched, saturated or unsaturated aliphatic group, and the position of an unsaturated bond is arbitrary.

Examples of the carbocyclic ketones may include C1-C40 carbocyclic ketones, such as cyclobutanone, cyclopentanone, cyclohexanone, acetophenone, propiophenone, butyrophenone, valerophenone, benzophenone, dibenzyl ketone, and 2-acetonaphthone. These compounds may have a straight or branched, saturated or unsaturated aliphatic group, the position of an unsaturated bond is arbitrary, and the position and number of substitution are arbitrary.

Examples of the heterocyclic ketones may include C1-C40 carbocyclic ketones, such as acetothienone and 2-acetofuron. These compounds may have a straight or branched, saturated or unsaturated aliphatic group, the position of an unsaturated bond is arbitrary, and the position and number of substitution are arbitrary.

Examples of the ketone alcohols may include C1-C40 ketone alcohols, such as acetol, acetoin, acetoethyl alcohol, diacetone alcohol, phenacyl alcohol, and benzoin. These compounds may have a carbocyclic or heterocyclic ring, or a carbocyclic or heterocyclic ring with a straight or branched, saturated or unsaturated aliphatic group, the position of an unsaturated bond is arbitrary, and the position and number of substitution are arbitrary.

Examples of the ketonic acids may include C1-C40 ketonic acids, such as α-ketonic acids including pyruvic acid, benzoylformic acid, and phenylpyruvic acid; β-ketonic acids including acetoacetic acid, propionylacetic acid, and benzoylacetic acid; and γ-ketonic acids including levulinic acid and β-benzoylpropionic acid.

The aldehydes are oxygen-containing organic compounds having one or more aldehyde groups, and may be saturated or unsaturated aliphatic aldehydes, carbocyclic aldehydes, heterocyclic aldehydes, and mixtures of two or more of these.

Examples of the saturated or unsaturated aliphatic aldehydes may include C1-C40 saturated or unsaturated aliphatic aldehydes, such as formaldehyde, acetoaldehyde, propionaldehyde, butylaldehyde, isobutylaldehyde, valeraldehyde, isovaleraldehyde, pivalinaldehyde, capronaldehyde, pelargonaldehyde, caprinaldehyde, undecylaldehyde, laurinaldehyde, tridecylaldehyde, myristinaldehyde, pentadecylaldehyde, palmitinaldehyde, margarinaldehyde, stearinaldehyde, acrolein, crotonaldehyde, propiolaldehyde, glyoxal, and succindialdehyde. These compounds may have a straight or branched, saturated or unsaturated aliphatic group, and the position of an unsaturated bond is arbitrary.

Examples of the carbocyclic aldehydes may include C1-C40 carbocyclic aldehydes, such as benzaldehyde, o-tolualdehyde, m-tolualdehyde, p-tolualdehyde, salicylaldehyde, cinnamaldehyde, α-naphthaldehyde, and β-naphthaldehyde. These compounds may have a straight or branched, saturated or unsaturated aliphatic group, the position of an unsaturated bond is arbitrary, and the position and number of substitution are arbitrary.

Examples of the heterocyclic aldehydes may include C1-C40 heterocyclic aldehydes, such as furfural. These compounds may have a straight or branched, saturated or unsaturated aliphatic group, the position of an unsaturated bond is arbitrary, and the position and number of substitution are arbitrary.

The carbonates are oxygen-containing organic compounds having one or more carbonate bonds, and may be carbonates having a saturated or unsaturated C1-C40 aliphatic group, a carbocyclic ring, a carbocyclic ring having a saturated or unsaturated aliphatic group, or a saturated or unsaturated aliphatic group having a carbocyclic ring, such as dimethyl carbonate, diethyl carbonate, di-n-propyl carbonate, diisopropyl carbonate, di-n-butyl carbonate, diisobutyl carbonate, di-tert-butyl carbonate, dipentyl carbonate, dihexyl carbonate, diheptyl carbonate, dioctyl carbonate, dinonyl carbonate, didecyl carbonate, diundecyl carbonate, didodecyl carbonate, ditridecyl carbonate, ditetradecyl carbonate, dipentadecyl carbonate, dihexadecyl carbonate, diheptadecyl carbonate, dioctadecyl carbonate, or diphenyl carbonate. These compounds may have a straight or branched, saturated or unsaturated aliphatic group, the position of an unsaturated bond is arbitrary, and the position and number of substitution are arbitrary.

Further, hydroxy(poly)oxyalkylene carbonates, wherein alkylene oxide is added to these carbonates, may also be used.

The above alcohols may be represented by the formula R—(OH)n, the carboxylic acids by the formula R—(COOH)n, the esters by the formula R—(COO—R')n, the ethers by the formula R—(O—R')n, the ketones by the formula R—(CO—R')n, the aldehydes by the formula R—(CHO)n, and the carbonates by the formula R—(O—COO—R')n.

R and R' in the above formulae each independently stands for a hydrocarbon group, such as an alkyl, alkenyl, alkylene, cycloalkyl, alkylcycloalkyl, aryl, alkylaryl, or aryl alkyl group, or a hydrocarbon group from which one or more hydrogen atoms are removed. The hydrocarbon group may optionally have one or more groups or bonds selected from the group consisting of a hydroxyl group, a carboxyl group, a carbonyl group, an ester bond, and an ether bond, or may optionally contain an element other than carbon, hydrogen, and oxygen, such as nitrogen, sulfur, a heterocyclic compound, halogen, for example, fluorine or chlorine, phosphorus, boron, metal, or the like.

The number of carbons in the hydrocarbon group is not particularly limited, and is preferably 1 to 40, more preferably 2 to 30, most preferably 3 to 20.

Examples of the alkyl group may include C1-C40 alkyl groups, such as methyl, ethyl, n-propyl, isopropyl, n-butyl, isobutyl, sec-butyl, tert-butyl, straight or branched pentyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched icosyl, straight or branched henicosyl, straight or branched docosyl, straight or branched tricosyl, and straight or branched tetracosyl groups. The alkyl group is preferably a C2-C30, more preferably C3-C20 alkyl group.

Examples of the alkenyl group may include C2-C40 alkenyl groups, such as vinyl, straight or branched propenyl, straight or branched butenyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched nonadecenyl, straight or branched icosenyl, straight or branched henicosenyl, straight or branched docosenyl, straight or branched tricosenyl, and straight or branched tetracosenyl groups. The alkenyl group may preferably be a C2-C30, more preferably C3-C20 alkenyl group.

Examples of the cycloalkyl group may include C3-C40 cycloalkyl groups, such as cyclopentyl, cyclohexyl, cycloheptyl, and cyclooctyl groups. The cycloalkyl group may preferably be a C3-C20, more preferably C5-C8 cycloalkyl group.

Examples of the alkylcycloalkyl group may include C4-C40 alkylcycloalkyl group, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups. The alkylcycloalkyl group may preferably be a C5-C20, more preferably C6-C12 alkylcycloalkyl group, and includes all possible structural isomers.

Examples of the aryl group may include C6-C20 aryl groups, such as phenyl and naphthyl groups. More preferably, the aryl group may be a C6-C10 aryl group.

Examples of the alkylaryl group may include 1-substituted phenyl groups, such as tolyl, ethylphenyl, straight or branched propylphenyl, straight or branched butylphenyl, straight or branched pentylphenyl, straight or branched hexylphenyl, straight or branched heptylphenyl, straight or branched octylphenyl, straight or branched nonylphenyl, straight or branched decylphenyl, straight or branched undecylphenyl, and straight or branched dodecylphenyl groups; and aryl groups having two or more same or different, straight or branched alkyl groups, such as xylyl, diethylphenyl, dipropylphenyl, 2-methyl-6-tert-butylphenyl, 2,6-di-tert-butyl-4-methylphenyl, and 2,6-di-tert-butyl-4-(3,5-di-tert-butyl-4-benzyl)phenyl groups. The alkylaryl group may be a C7-C40, preferably C7-C20, more preferably C7-C12 alkylaryl group. The alkyl group may optionally have an aryl, alkylaryl, or arylalkyl group, and includes all possible structural isomers.

Examples of the arylalkyl group may include C7-C40 arylalkyl groups, such as benzyl, phenylethyl, phenylpropyl, phenylbutyl, phenylpentyl, and phenylhexyl groups. The arylalkyl group may preferably be a C7-C20, more preferably C7-C12 arylalkyl group, and includes all possible structural isomers.

The oxygen-containing organic compounds may also be derivatives of the compounds mentioned above. Such derivatives may include, but not limited to, the compounds obtained by reacting, with the oxygen-containing organic compound, at least one of nitrogen-containing compounds, sulfur, sulfur-containing compounds, boron-containing compounds, halogens, halogen compounds, metal elements, organic or inorganic metal-containing compounds, and alkylene oxides. For example, compounds obtained by sulfuration of, or halogenation, such as fluorination or chlorination, of at least one compound selected from the group consisting of the above alcohols, carboxylic acids, esters, ethers, ketones, aldehydes, and carbonates; reaction products of at least one compound selected from the above group with sulfuric acid, nitric acid, boric acid, or phosphoric acid, esters or metal salts of these acids; alkylene oxide addition products obtained by reaction of at least one compound selected from the above group with metal, metal-containing compounds, or alkylene oxides; or reaction products of at least one compound selected from the above group with amine compounds, may be used.

Among these, reaction products of at least one compound selected from the group consisting of the alcohols, carboxylic acids, aldehydes, and derivatives thereof, with amine compounds, such as Mannich reaction products; acrylation products of at least one compound selected from the above group; and amides of at least one compound selected from the above group, are preferably used.

The amine compounds may be ammonia, monoamine, diamine, or polyamine. Specific examples of the amine compounds may include ammonia; alkylamines having a straight or branched C1-C30 alkyl group, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, stearylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight or branched C2-C30 alkenyl group, such as ethenylamine, propenylamine, butenylamine, octenylamine, and oleylamine; alkanolamines having a straight or branched C1-C30 alkanol group, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; straight or branched C1-C30 alkylenediamine, such as methylenediamine, ethylenediamine, propylenediamine, and butylenediamine; polyamines, such as diethylenetriamine, triethylenetetramine, tetraethylenepentamine, and pentaethylenehexamine; the above monoamines, diamines, polyamines having a C8-C20 alkyl or alkenyl group, such as undecyldiethylamine, undecyldiethanolamine, dodecyldipropanolamine, oleyldiethanolamine, oleylpropylenediamine, and stearyltetraethylenepentamine; heterocyclic compounds, such as N-hydroxyethyloleylimidazoline; alkylene oxide addition products of these compounds; and mixtures thereof.

Among these nitrogen compounds, aliphatic amines having C10-C20 alkyl or alkenyl groups, straight or branched alkyl amines, and (alkyl or alkenyl group may be straight or branched chain, such as decylamine, dodecylamine, tridecylamine, heptadecylamine, octadecylamine, oleylamine, and strearylamine, are preferred.

Among the above-mentioned derivatives of the oxygen-containing organic compounds, amides of the C8-C20 carboxylic acids from the aliphatic monocarboxylic acids and the amine compounds, such as oleamide, are particularly preferred.

The oxygen-containing organic compounds have been discussed. Among the listed compounds, those having a hydroxyl group are preferred for giving superior friction reducing effect. Further, an alcoholic hydroxyl group is more preferred than a hydroxyl group directly bonded to a carbonyl group, such as a carboxyl group, for giving still superior friction reducing effect. The number of such hydroxyl groups in the compound is not particularly limited, but the compound preferably contains as many hydroxyl groups as possible for superior friction reducing effect. However, when the compound is used with a medium, such as the lubricant base oil, the number of the hydroxyl groups may be restricted in view of the solubility.

The aliphatic amines may be those having a straight or branched, C6-C30, preferably C8-C24, more preferably C10-C20, aliphatic hydrocarbon group. If the number of carbon atoms is outside the range of 6 to 30, sufficient friction reducing effect may not be achieved. Other hydrocarbon groups may optionally be contained, as long as the straight or branched aliphatic hydrocarbon groups within the above-mentioned range are contained.

Examples of the straight or branched C6-C30 aliphatic hydrocarbon groups may include alkyl groups, such as hexyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl groups; and alkenyl groups, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, henicosenyl, docosenyl, tricosenyl, tetracosenyl, pentacosenyl, hexacosenyl, heptacosenyl, octacosenyl, nonacosenyl, and triacontenyl groups.

The above alkyl and alkenyl groups may either be straight or branched, and the double bond in the alkenyl group may be at an arbitrary position.

The aliphatic amines may be various amine compounds, such as monoamines, polyamines, alkanolamines, or imidazoline compounds having the straight or branched C6-C30 aliphatic hydrocarbon group mentioned above, or derivatives thereof.

Examples of the monoamines may include laurylamine, lauryldiethylamine, palmitinamine, stearylamine, and oleylamine.

Examples of the polyamines may include stearyltetraethylenepentamine and oleylpropylenediamine.

Examples of the alkanolamines may include lauryldiethanolamine, dodecyldipropanolamine, and oleyldiethanolamine.

Examples of the nitrogen-containing heterocyclic compounds may include N-hydroxyethyloleylimidazoline.

The derivatives may be alkylene oxide addition products, acid modified compounds, or the like.

The alkylene oxide addition products may be compounds obtained by addition reaction of alkylene oxide to a nitrogen atom in the various amine compounds mentioned above. Examples of the alkylene oxide addition products may include N,N-dipolyoxyalkylene-N-alkyl- or alkenylamine obtained by addition reaction of alkylene oxide to a primary monoamine having a C6-C28 alkyl or alkenyl group, more specifically, N,N-dipolyoxyethylene-N-oleylamine.

The acid modified compounds may be obtained by reacting, to the above-mentioned various amines, the above carboxylic acids, preferably the aliphatic monocarboxylic acids, in particular C2-C30 aliphatic monocarboxylic acids, the above aliphatic polycarboxylic acids, in particular C2-C30 aliphatic polycarboxylic acids, including oxalic acid, or the above carbocyclic carboxylic acids, in particular C6-C30 carbocyclic carboxylic acids, including phthalic acid, trimellitic acid, or pyromellitic acid, to fully or partially neutralize or amidify the amino and/or imino groups.

The lubricant of the present invention may optionally contain a friction modifier as desired for further improving the friction reducing effect. The content of the friction modifier, if any, is not particularly limited, and is usually not more than 3.0 mass %, preferably 0.05 to 3.0 mass %, more preferably 0.1 to 2.0 mass %, most preferably 0.5 to 1.4 mass %, of the total amount of the lubricant.

The lubricant of the present invention may optionally contain, in addition to the above components, other additives selected from the group consisting of viscosity index improvers, pour point depressants, anti-wear agents, extreme pressure agents, friction modifiers other than the above, metal detergents other than component (B), ashless dispersants, anti-oxidants other than component (D), rust inhibitors, metal deactivators, surfactants, demulsifiers, seal swelling agents, foam inhibitors, coloring agents, and mixtures thereof, depending on the desired performance.

The viscosity index improver may be a so-called non-dispersant type viscosity index improver, such as a polymer of various methacrylic acids or a hydrogenation products thereof, or a copolymer thereof in an arbitrary combination and a hydrogenation product thereof; or a so-called dispersant type viscosity index improver further including copolymerized therewith various methacrylates having a nitrogen compound. Non-dispersant or dispersant type ethylene-α-olefin copolymers and hydrides thereof, polyisobutylene and hydrogenation products thereof, hydrogenated products of styrene-diene copolymers, styrene-maleic anhydride ester copolymers, polyalkylstyrene, and the like may also be used. The α-olefin may preferably be propylene, 1-butene, or 1-pentene.

The molecular weight of the viscosity index improver should be selected in the light of shear stability. Specific examples of the number average molecular weight of the viscosity index improver may be usually 5000 to 1000000, preferably 100000 to 800000 for the dispersant or non-dispersant type polymethacrylate; and usually 800 to 5000 for polyisobutylene or hydrides thereof; and usually 800 to 300000, preferably 10000 to 200000 for ethylene-α-olefin copolymers and hydrides thereof. One or a combination of a plurality of kinds of the viscosity index improvers may be used, and a preferred content is usually 0.1 to 40.0 mass % of the total amount of the lubricant.

Among these, polymethacrylate viscosity index improvers are particularly preferred for maintaining the low friction property.

The pour point depressant may be a pour point depressant suitable for the lubricant base oil. For example, polymethacrylate-based pour point depressant may be used.

The anti-wear agents and extreme pressure agents may be known anti-wear agents and extreme pressure agents used in lubricants. Examples of these may include phosphorus compounds, such as phosphites, phosphates, thiophosphites, thiophosphates, dithiophosphates, metal salts thereof, such as zinc salts thereof, or amine salts thereof; and sulfur-containing extreme pressure agents, such as sulfurized oils and fats, sulfurized esters, olefin sulfides, and dithiocarbamates. As the anti-wear agent, a sulfur-free phosphorus anti-wear agent is preferred for its ability to achieve and maintain low friction property. A dithiocarbamate anti-wear agent is also preferred for its excellent ability to maintain low friction property.

In the lubricant of the present invention, the content of the anti-wear agent and/or the extreme pressure agent, if any, is not particularly limited, and is usually 0.1 to 5 mass % of the total amount of the lubricant. In particular, when the phosphorus anti-wear agent is used, the content thereof is not particularly limited, and is usually 0.01 to 0.1 mass %, preferably not more than 0.08 mass %, more preferably not more than 0.06 mass % of the total amount of the composition in terms of phosphorus elements. When the sulfur-containing anti-wear agent is used, the content thereof is not particularly limited, and is preferably not more than 0.15 mass %, more preferably not more than 0.1 mass %, most preferably not more than 0.05 mass % of the total amount of the lubricant in terms of sulfur elements. It is particularly preferred that the sulfur-containing anti-wear agent is not contained.

The other friction modifiers may be, for example, molybdenum dithiocarbamate, molybdenum dithiophosphate, or molybdenum disulfide.

The ashless dispersant may be a known dispersant used in lubricants. Preferred examples may include polybutenyl succinimide dispersants, polybutenyl benzylamine dispersants, polybutenylamine dispersants, and Mannich dispersants, wherein the polybutenyl group has a number average molecular weight of preferably 700 to 3500, more preferably 900 to 2500. The ashless dispersant may also be boron compound derivatives, carboxylic acid derivatives, or the like.

The content of the ashless dispersant, if any, is not particularly limited, and is usually 0.1 to 15 mass % of the total amount of the lubricant.

The anti-oxidant other than component (D) may be a known anti-oxidant used in lubricants. Preferred examples may include metal-based anti-oxidants, such as molybdenum-based anti-oxidants and copper-based anti-oxidants.

The content of the anti-oxidant, if any, in the lubricant of the present invention is not particularly limited, and is usually 0.01 to 3 mass % of the total amount of the lubricant.

When the anti-oxidant is contained in the lubricant of the present invention, the anti-oxidant may preferably be a molybdenum-based anti-oxidant, such as molybdenum dithiocarbamate, molybdenum dithiophosphate, a molybdenum-amine complex, or a molybdenum-succinimide complex, in particular, molybdenum dithiocarbamate. The content of the molybdenum-based anti-oxidant may be 0.001 to 0.1 mass %, preferably not more than 0.03 mass %, more preferably not more than 0.02 mass % of the total amount of the lubricant in terms of molybdenum elements.

The rust inhibitor may be, for example, alkylbenzene sulfonate, dinonylnaphthalene sulfonate, alkenylsuccinate, or polyhydric alcohol ester.

The demulsifier may be, for example, a polyalkylene glycol-based nonionic surfactant, such as polyoxyethylene alkyl ether, polyoxyethylene alkylphenyl ether, or polyoxyethylene alkylnaphthyl ether.

The metal deactivator may be, for example, imidazoline, a pyrimidine derivative, benzotriazole, or thiadiazole.

The foam inhibitor may be, for example, silicon, fluorosilicon, or fluoroalkyl ether.

In the lubricant of the present invention, the content of the rust inhibitor and/or demulsifier, if any, is not particularly limited, and is usually 0.01 to 5 mass % of the total amount of the lubricant. The content of the metal deactivator, if any, is not particularly limited, and may suitably be selected from the range of usually 0.0005 to 1 mass % of the total amount of the lubricant.

Among the optional additives mentioned above, zinc dithiophosphate and sulfur-containing metal detergents, such as alkaline earth metal sulfonates and alkaline earth metal phenates crosslinked with sulfur, may inhibit achievement or maintenance of low friction between the DLC contact surfaces. Thus it is preferred that these components are not contained substantially. For the same reasons, it is preferred that, among the additives selected from the above, sulfur-containing additives are contained as little as possible, and more preferably not contained substantially. Further, the diluents contained in the additives are preferably those having a low total aromatic content and a low sulfur content, and more preferably those having substantially no aromatic and sulfur contents.

In view of the above, the total sulfur content of the lubricant of the present invention is preferably not more than 0.2 mass %, more preferably not more than 0.1 mass %, still more preferably not more than 0.05 mass %, particularly preferably not more than 0.01 mass %, more particularly preferably not more than 0.005 mass %. It is most preferred that the lubricant is substantially free of sulfur.

In the system of the present invention, the lubricant of the present invention may be interposed between the contact surfaces by supplying the lubricant of the present invention between the contact surfaces in a manner suitable for the type of the system, such as a sealed or circulating type, and operating the system.

The system of the present invention has relatively moveable, facing contact surfaces at least one of which is coated with DLC, and may be, for example, an internal combustion engine, such as a four- or two-cycle engine, and more specifically, valve trains, pistons, piston rings, piston skirts, cylinder liners, connecting rods, crank shafts, bearings, roller bearings, metal gears, chains, belts, oil pumps, and the like. Further drive transmission mechanisms, such as gears, drives having contact surfaces of a hard disk drive, and other systems having various contact surfaces working under severe friction conditions and required to have low friction property, are also included.

In the system of the present invention, preferred examples of the valve trains in an internal combustion engine may include valve trains having contact surfaces composed of a disk-shaped shim or a lifter crown surface produced by forming a DLC film over a steel substrate, and a cam lobe made of a low alloy chilled cast iron, carburized steel, or thermal refining carbon steel, or a material of an arbitrary combination of these.

The method of lubricating DLC contact surfaces according to the present invention may be practiced by lubricating the above mentioned relatively movable, facing contact surfaces at least one of which is coated with DLC, by supplying therebetween the lubricant of the present invention. By supplying the lubricant of the present invention to lubricate the DLC-coated surface, the low friction property of the DLC contact surfaces may be maintained stably for a prolonged period of time.

EXAMPLES

The present invention will now be explained in more detail with reference to Examples and Comparative Examples, but the present invention is not limited to the Examples and may be modified or improved in various ways.

Examples 1-1 to 1-2 and Comparative Examples 1-1 to 1-2

As an example of the contact surfaces in a low friction motion system, test pieces for an SRV friction tester manufactured by OPTIMOL INSTRUMENTS were prepared. The test pieces were prepared by grinding a SUJ2 heat treated material into a disk-shaped material and a columnar material, and polishing these materials with a wrapping tape into a predetermined surface roughness (Ra=0.2 μm or lower). The surface of the obtained disk-shaped material was coated with DLC of the a-C (amorphous carbon) type by CVD treatment to have a predetermined thickness as shown in Table 1, and polished with a wrapping tape into a predetermined surface roughness (Ra=0.1 μm or lower). The obtained test pieces are shown in FIG. 1, and the data thereof in Table 1.

In FIG. 1, reference numeral 10 refers to the disk, 11 refers to the column, and the arrows indicate the downward pressure applied and the horizontal sliding motion of the column 11 on the disk 10 in the performance test to be discussed later.

TABLE 1

| | Substrate | DLC coating film | Film thickness (μm) | Surface hardness Hv | Surface roughness Ra (μm) |
|---|---|---|---|---|---|
| Disk | SUJ2 heat treated material | a-C | 1.1 | 1800 | 0.04 |
| Column | SUJ2 heat treated material | none | — | 750 | 0.05 |

(Preparation of Lubricant)

Lubricants of Examples 1-1 and 1-2 according to the present invention, and lubricants of Comparative Examples 1-1 and 1-2 for comparison were prepared as shown in Table 2. The obtained lubricants were subjected to the following performance test. The results are shown in Table 2.

In Table 2, base oil I is a severely hydrocracked mineral oil having a kinematic viscosity of 4.0 $mm^2/s$ at 100° C., a viscosity index of 125, a total aromatic content of 1.0 mass %, and a sulfur content of 0.001 mass %. Base oil II is a poly-α-olefin base oil (SHF41 manufactured by Exxon-Mobil Chemical) substantially free of aromatic and sulfur compounds, having a kinematic viscosity of 3.9 $mm^2/s$ at 100° C., and a viscosity index of 123. Base oil III is a solvent-dewaxed mineral oil having a kinematic viscosity of 4.4 $mm^2/s$ at 100° C., a viscosity index of 102, a total aromatic content of 21.0 mass %, and a sulfur content of 0.60 mass %. The additive package is an SG grade package containing zinc dithiophosphate, calcium sulfonate, and the like. The lubricant of Comparative Example 1-2 had a total sulfur content of 0.35 mass %.

(Performance Test)

The test pieces prepared above were set on an OPTIMOL SRV tester, each lubricant shown in Table 2 was dropped onto the test pieces, and the friction coefficient after 10 and 30 minutes were measured under the following conditions. The results are shown in Table 2.

The friction coefficient after 10 minutes indicates an initial friction coefficient after stabilization, and the friction coefficient after 30 minutes indicates a friction coefficient in a state wherein a lubricating film is formed over the contact surfaces, or the lubricant may undergo oxidative deterioration or reaction. By this test, the initial friction property and maintenance thereof may be evaluated in a short time.

<Test Conditions>

Temperature: 80° C.; Load: 400 N; Amplitude of oscillation: 3 mm; Frequency: 50 Hz

TABLE 2

| | Ex. 1-1 | Ex. 1-2 | Comp. Ex. 1-1 | Comp. Ex. 1-2 |
|---|---|---|---|---|
| Base oil (mass % based on total amount of base oil) | | | | |
| Base oil I (Lubricant base oil (A)) | 100 | — | — | 100 |
| Base oil II (Lubricant base oil (A)) | — | 100 | — | — |

TABLE 2-continued

| | | Ex. 1-1 | Ex. 1-2 | Comp. Ex. 1-1 | Comp. Ex. 1-2 |
|---|---|---|---|---|---|
| Base oil III | | — | — | 100 | — |
| Additive package (mass % based on total amount of composition) | | — | — | — | 13.6 |
| Results of performance test | | | | | |
| SRV friction test: | after 10 minutes | 0.050 | 0.043 | 0.065 | 0.082 |
| : | after 30 minutes | 0.043 | 0.040 | 0.092 | 0.095 |

From Table 2, it is seen that the lubricants of Examples exhibited extremely low friction coefficients after 10 minutes, and the friction coefficient was not observed to increase even after 30 minutes, indicating that the low friction property was maintained stably. On the contrary, the lubricant of Comparative Example 1-1, which is composed substantially of a lubricant base oil out of the range of the present invention, and the lubricant of Comparative Example 1-2, which contains a lubricant base oil within the range of the present invention, and additives including zinc dithiophosphate and a sulfonate detergent, exhibited high friction coefficients after 10 minutes, and the friction coefficient was observed to be remarkably increased after 30 minutes, indicating that the friction property was not maintained.

Examples 2-1 to 2-3

Referential Example 2-1, and Comparative Example 2-1

Preparation of Lubricant Composition

Lubricants of Examples 2-1 to 2-3 according to the present invention, and lubricants of Referential Example 2-1 and Comparative Example 2-1 for comparison were prepared as shown in Table 3. The obtained lubricants were subjected to the following performance test, using the test pieces and the system similar to those used in Example 1-1 shown in Table 1 and FIG. 1. The results are shown in Table 3.

In Table 3, base oil I is the same as that in Table 2. Sulfur-free metal detergent I is an overbased calcium salicylate containing calcium carbonate, having a total base number of 166 mgKOH/g and a calcium content of 6.2 mass %; Sulfur-free metal detergent II is an overbased calcium salicylate containing calcium borate, having a total base number of 170 mgKOH/g and a calcium content of 6.8 mass %; and the sulfur-containing metal detergent is an overbased calcium sulfonate containing calcium carbonate, having a total base number of 320 mgKOH/g, a calcium content of 12.5 mass %, and a sulfur content of 2 mass %. Friction modifier I is glycerin monooleate. Additive package I contains zinc dialkylphosphate, a viscosity index improver, an anti-oxidant, a dispersant, and the like; and additive package II is an SG grade package containing zinc dithiophosphate and calcium sulfonate.

(Performance Test)

(1) The SRV friction test was conducted in the same way as in Example 1-1, except that the lubricants shown in Table 3 were used. The results are shown in Table 3.

(2) Engine Motoring Friction Test

The engine motoring friction test was conducted under the following conditions, using, as engine shims, an ordinary steel shim and a DLC-coated steel shim having the same film thickness, surface hardness, and surface roughness as mentioned above. On the basis of the friction torque obtained with the ordinary steel shim and the lubricant of Comparative Example 2-1, a friction torque reduction rate was measured for the lubricant of Example 2-3. The results are shown in Table 3. Incidentally, the engine motoring friction test allows evaluation of practical energy-saving property of the whole engine, compared to the laboratory evaluation by the SRV friction test.

<Test Conditions>

A: oil temperature at 100° C., engine revolution at 800 rpm

B: oil temperature at 60° C., engine revolution at 2000 rpm (3) Low Friction Property Maintenance Performance Test Each lubricant was oxidized in accordance with JIS K 2514 "Lubricating oils—Determination of oxidation stability" at "4. Determination of Stability of Lubricating Oils for Internal Combustion Engines (ISOT)". After the test, each oxidized oil was subjected to the SRV friction test mentioned above, and the friction coefficient after 30 minutes was measured. This test is conducted for detailed evaluation of maintenance performance of the low friction property.

TABLE 3

| | Ex. 2-1 | Ex. 2-2 | Ref. Ex. 2-1 | Ex. 2-3 | Comp. Ex. 2-1 |
|---|---|---|---|---|---|
| Base oil (mass % based on total amount of base oil) | | | | | |
| Base oil I (Lubricant base oil (A)) | 100 | 100 | 100 | 100 | 100 |
| Additive (mass % based on total amount of composition) | | | | | |
| (B) Sulfur-free metal detergent I | 3.0 | — | — | 3.0 | — |
| (B) Sulfur-free metal detergent II | — | 3.0 | — | — | — |
| Sulfur-containing metal detergent | — | — | 1.5 | — | — |
| Friction Modifier I | 1.0 | 1.0 | 1.0 | 1.0 | — |

TABLE 3-continued

| | | Ex. 2-1 | Ex. 2-2 | Ref. Ex. 2-1 | Ex. 2-3 | Comp. Ex. 2-1 |
|---|---|---|---|---|---|---|
| Additive package I | | — | — | — | 12.0 | — |
| Additive package II | | — | — | — | — | 13.6 |
| Results of Performance Test | | | | | | |
| (1) SRV friction test: | after 10 minutes | 0.041 | 0.041 | 0.062 | 0.043 | 0.082 |
| : | after 30 minutes | 0.043 | 0.042 | 0.082 | 0.045 | 0.095 |
| (2) Engine motoring friction test - shim | | — | — | — | a-C | steel |
| Friction torque reduction rate (%) | | | | | | |
| | 800 rmp, 100° C. | — | — | — | 18.8 | 0 (std) |
| | 2000 rpm, 60° C. | — | — | — | 6.6 | 0 (std) |
| (3) Low friction property maintenance performance test (after 30 minutes) | | 0.058 | — | — | — | — |

From Table 3, it is seen that the lubricants of Examples 2-1 to 2-3 containing a metal detergent without sulfur, exhibited extremely low friction coefficients after 10 minutes, and the friction coefficient was not observed to increase even after 30 minutes, indicating that the low friction property was maintained stably.

On the contrary, the lubricant composition of Comparative Example 2-1 containing zinc dithiophosphate and a calcium sulfonate detergent exhibited high friction coefficients both after 10 minutes and after 30 minutes, and the friction coefficient was poorly maintained. The lubricant of Referential Example 2-1 containing both the sulfur-containing metal detergent and glycerin monooleate, exhibited a sufficiently low friction coefficient, but the friction coefficient was observed to increase after 30 minutes, indicating that the low friction property was poorly maintained.

When the DLC-coated shim and the lubricant of Example 2-3 containing a sulfur-free metal detergent were used, an extremely superior friction torque reduction rate was achieved, i.e., about 19% under high temperature, low revolution conditions, and about 7% under low temperature, high revolution conditions, compared to the friction torque achieved with the ordinary steel shim and the lubricant of Comparative Example 2-1.

Examples 3-1 to 3-2

Referential Example 3-1, and Comparative Example 3-1

Preparation of Lubricant Composition

Lubricants of Examples 3-1 to 3-2 according to the present invention and lubricants of Referential Example 3-1 and Comparative Example 3-1 for comparison were prepared as shown in Table 4. The obtained lubricants were subjected to (1) SRV friction test in the same way as in Example 2-1, using the test pieces and the system similar to those used in Example 1-1 shown in Table 1 and FIG. 1, (2) engine motoring friction test, and (3) low friction property maintenance performance test. The results are shown in Table 4.

In Table 4, base oil I is the same as that in Table 2. The sulfur-free phosphorus compound is zinc dialkylphosphate wherein the alkyl groups are butyl groups, and contains 7.5 mass % phosphorus and a diluent. The zinc dialkyldithiophosphate has a phosphorus content of 7.2 mass % and a secondary/primary ratio of 65/35 (by mass of phosphorus content). Additive package I contains an overbased calcium salicylate containing calcium carbonate, a viscosity index improver, an anti-oxidant (ashless type and MoDTC), a dispersant, and the like. Friction modifier I and additive package II are the same as those in Table 3.

TABLE 4

| | | Ex. 3-1 | Ref. Ex. 3-1 | Ex. 3-2 | Comp. Ex. 3-1 |
|---|---|---|---|---|---|
| Base oil (mass % based on total amount of base oil) | | | | | |
| Base oil I (Lubricant base oil (A)) | | 100 | 100 | 100 | 100 |
| Additive (mass % based on total amount of composition) | | | | | |
| (C) Sulfur-free phosphorus compound | | 1.0 | — | 1.0 | — |
| Zinc dialkyldithiophosphate | | — | 1.1 | — | — |
| Friction Modifier I | | 1.0 | 1.0 | 1.0 | — |
| Additive package I | | — | — | 14.2 | — |
| Additive package II | | — | — | — | 13.6 |
| Results of Performance Test | | | | | |
| (1) SRV friction test: | after 10 minutes | 0.038 | 0.062 | 0.045 | 0.082 |
| : | after 30 minutes | 0.040 | 0.095 | 0.045 | 0.095 |

TABLE 4-continued

| | Ex. 3-1 | Ref. Ex. 3-1 | Ex. 3-2 | Comp. Ex. 3-1 |
|---|---|---|---|---|
| (2) Engine motoring friction test - shim | — | — | a-C | steel |
| Friction torque reduction rate (%) | | | | |
| 800 rpm, 100° C. | — | — | 19.0 | 0 (std) |
| 2000 rpm, 60° C. | — | — | 8.0 | 0 (std) |
| (3) Low friction property maintenance performance test (after 30 minutes) | 0.056 | — | — | — |

From Table 4, it is seen that the lubricants of Examples 3-1 to 3-2 containing a sulfur-free phosphorus compound, exhibited extremely low friction coefficients after 10 minutes, and the friction coefficient was not observed to increase even after 30 minutes, indicating that the low friction property was maintained stably.

On the contrary, the lubricant of Comparative Example 3-1 containing zinc dithiophosphate and a calcium sulfonate detergent exhibited high friction coefficients both after 10 minutes and after 30 minutes, and the friction coefficient was poorly maintained. The lubricant of Referential Example 3-1 containing both zinc dithiophosphate and glycerin monooleate, exhibited a sufficiently low friction coefficient, but the friction coefficient was observed to increase after 30 minutes, indicating that the low friction property was poorly maintained. Incidentally, the lubricant of Example 3-2 contains as the anti-oxidant a combination of an ashless anti-oxidant and a Mo-containing anti-oxidant (MoDTC content: 0.02 mass % of the composition in terms of Mo). It was demonstrated that MoDTC, unlike zinc dithiophosphate, did not have a negative impact on the low friction maintenance performance.

When the DLC-coated shim and the lubricant composition of Example 3-2 containing a sulfur-free phosphorus compound were used, an extremely superior friction torque reduction rate was achieved, i.e. about 19% under high temperature, low revolution conditions, and about 8% under low temperature, high revolution conditions, compared to the friction torque achieved with the ordinary steel shim and the lubricant of Comparative Example 1.

Examples 4-1 to 4-2 and Comparative Example 4-1

Preparation of Lubricant Composition

Lubricants of Example 4-1 to 4-2 according to present invention and a lubricant of Comparative Example 4-1 for comparison were prepared as shown in Table 5. The obtained lubricants were subjected to (1) SRV friction test in the same way as in Example 1-1, using the test pieces and the system similar to those in Example 1-1 shown in Table 1 and FIG. 1, and (3) low friction property maintenance performance test in the same way as in Example 2-1. The results are shown in Table 5.

In Table 5, base oil I is the same as that in Table 2. Sulfur-free anti-oxidant I is octyl-3-(3,5-di-tert-butyl-4-hydroxyphenyl)propionate, whereas sulfur-free anti-oxidant II is alkyldiphenylamine. Friction modifier I is glycerin monooleate.

TABLE 5

| | Ex. 4-1 | Ex. 4-2 | Comp. Ex. 4-1 |
|---|---|---|---|
| Base oil (mass % based on total amount of base oil) | | | |
| Base oil I (Lubricant base oil (A)) | 100 | 100 | 100 |
| Additive (mass % based on total amount of composition) | | | |
| (D) Sulfur-free anti-oxidant I | 1.0 | — | — |
| (D) Sulfur-free anti-oxidant II | — | 1.0 | — |
| Sulfur-containing anti-oxidant[1)] | — | — | 0.8 |
| Friction Modifier I | 1.0 | 1.0 | 1.0 |
| Polymethacrylate viscosity index improver | 5.0 | 5.0 | 5.0 |
| Results of Performance Test | | | |
| (1) SRV friction test: after 10 minutes | 0.041 | 0.041 | 0.056 |
| : after 30 minutes | 0.043 | 0.039 | 0.062 |
| (3) Low friction property maintenance performance test (after 30 minutes) | 0.059 | 0.057 | — |

1)

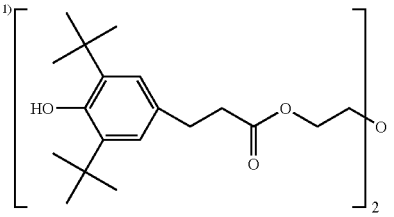

From Table 5, it is seen that the lubricants of Examples 4-1 to 4-2 containing a sulfur-free ashless anti-oxidant, exhibited extremely low friction coefficients after 10 minutes, and the friction coefficients were not observed to increase even after 30 minutes, indicating that the low friction property was maintained stably.

On the contrary, the lubricant of Comparative Example 4-1 containing a sulfur-containing ashless anti-oxidant, exhibited a high friction coefficient after 10 minutes, and the friction coefficient was observed to increase after 30 minutes.

Examples 5-1 to 5-7

Preparation of Lubricant Composition

Lubricants of Examples 5-1 to 5-7 according to the present invention were prepared as shown in Table 6. The obtained lubricants were subjected to (1) SRV friction test in the same way as in Example 1-1, using the test pieces and the system similar to those in Example 1-1 shown in Table 1 and FIG. 1, and (3) low friction property maintenance performance test in the same way as in Example 2-1. The results are shown in Table 6.

In Table 6, base oil I and the various additives are the same as those in Tables 2 to 5.

TABLE 6

| | Ex. 5-1 | Ex. 5-2 | Ex. 5-3 | Ex. 5-4 | Ex. 5-5 | Ex. 5-6 | Ex. 5-7 |
|---|---|---|---|---|---|---|---|
| Base oil (mass % based on total amount of base oil) | | | | | | | |
| Base oil I (Lubricant base oil (A)) | 100 | 100 | 100 | 100 | 100 | 100 | 100 |
| Additive (mass % based on total amount of composition) | | | | | | | |
| (B) Sulfur-free metal detergent I | 3.0 | 3.0 | 3.0 | — | 3.0 | — | — |
| (C) Sulfur-free phosphorus compound | 1.0 | — | — | 1.0 | 1.0 | — | — |
| (D) Sulfur-free anti-oxidant I | — | 1.0 | — | 1.0 | 1.0 | 1.0 | — |
| (D) Sulfur-free anti-oxidant II | — | — | 1.0 | — | — | — | 1.0 |
| Friction Modifier I | 1.0 | 1.0 | 1.0 | 1.0 | 1.0 | 1.0 | 1.0 |
| Results of Performance Test | | | | | | | |
| (1) SRV friction test: after 10 minutes | 0.040 | 0.039 | 0.036 | 0.039 | 0.039 | 0.042 | 0.041 |
| : after 30 minutes | 0.042 | 0.039 | 0.036 | 0.038 | 0.039 | 0.043 | 0.042 |
| (3) Low friction property maintenance performance test (after 30 minutes) | 0.048 | 0.046 | 0.047 | 0.046 | 0.045 | 0.057 | 0.058 |

From Table 6 in view of Tables 3 to 5, it is seen that addition of components (B) to (D) did not substantially affect the friction property of the fresh oils. However, in the friction test on the oxidized (deteriorated) oils after ISOT, which is a typical test for promoting oxidative deterioration of lubricants, it was demonstrated that the friction coefficients remarkably increased compared to those of the fresh oils. However, addition of components (B) to (D) inhibited such increase and improved the maintenance performance of the low friction property.

What is claimed is:

1. A system having diamond-like carbon (DLC) contact surfaces, comprising:

relatively movable, facing contact surfaces at least one of which is coated with DLC, and a lubricant for a system having DLC contact surfaces interposed between said contact surfaces, said lubricant fulfilling following conditions (a), (b), (c), and (d):

(a) wherein said lubricant for a system having DLC contact surfaces comprises a lubricant base oil (A) containing, as a main component, a base oil (X) selected from the group consisting of a hydrocracked mineral oil, a wax-isomerized mineral oil, a poly-α-olefin base oil, and mixtures thereof, wherein said base oil (X) has a kinematic viscosity of 3.5 to 5 $mm^2/s$ at 100° C., a total aromatic content of 0 to 2 mass %, and a sulfur content of not higher than 0.002 mass %;

(b) wherein said lubricant for a system having DLC contact surfaces has a sulfur content of not higher than 0.2 mass %;

(c) wherein said lubricant comprises 0.5 to 1.4 mass % friction modifier comprising glycerin monooleate, and at least two of a 0.05 to 0.2 mass % alkali metal or alkaline earth metal salicylate in terms of metal element as sulfur-free metal detergent (B), a 0.01 to 0.1 mass % zinc dialkylphosphate in terms of phosphorus elements as a sulfur-free phosphorus compound (C), and a 0.5 to 2 mass % sulfur-free ashless anti-oxidant (D); and (d) wherein said lubricant is free of sulfur-containing additives selected from the group consisting of zinc dithiophosphate, sulfur-containing metal detergents, and mixtures thereof.

2. The system according to claim 1, wherein said contact surfaces comprise contact surfaces in an internal combustion engine.

3. A method of lubricating DLC contact surfaces, comprising lubricating relatively movable, facing contact surfaces at least one of which is coated with DLC, with a lubricant for a system having DLC contact surfaces interposed between said contact surfaces, said lubricant fulfilling following conditions (a), (b), (c), and (d):

(a) wherein said lubricant for a system having DLC contact surfaces comprises a lubricant base oil (A) containing, as a main component, a base oil (X) selected from the group consisting of a hydrocracked mineral oil, a wax-isomerized mineral oil, a poly-α-olefin base oil, and mixtures thereof, wherein said base oil (X) has a kinematic viscosity of 3.5 to 5 $mm^2/s$ at 100° C., a total aromatic content of 0 to 2 mass %, and sulfur content of not higher than 0.002 mass %;

(b) wherein said lubricant for a system having DLC contact surfaces has a sulfur content of not higher than 0.2 mass %;

(c) wherein said lubricant comprises 0.5 to 1.4 mass % friction modifier comprising glycerin monooleate, and at least two of a 0.05 to 0.2 mass % alkali metal or alkaline earth metal salicylate in terms of metal element as sulfur-free metal detergent (B), a 0.01 to 0.1 mass % zinc dialkylphosphate in terms of phosphorus elements as a sulfur-free phosphorus compound (C), and a 0.5 to 2 mass % sulfur-free ashless anti-oxidant (D); and (d) wherein said lubricant is free of sulfur-containing additives selected from the group consisting of zinc dithiophosphate, sulfur-containing metal detergents, and mixtures thereof.

4. A lubricant for a system having DLC contact surfaces, said lubricant being for lubricating relatively movable, facing contact surfaces at least one of which is coated with DLC, and fulfilling following conditions (a), (b), (c), and (d):

(a) wherein said lubricant for a system having DLC contact surfaces comprises a lubricant base oil (A) containing a base oil (X) as a main component, said base oil (X) selected from the group consisting of a hydrocracked mineral oil, a wax-isomerized mineral oil, a poly-α-olefin base oil, and mixtures thereof, and having a kinematic viscosity of 3.5 to 5 $mm^2/s$ at 100° C., a total aromatic content of 0 to 2 mass %, and a sulfur content of not higher than 0.002 mass %;

(b) wherein said lubricant for a system having DLC contact surfaces has a sulfur content of not higher than 0.2 mass %;

(c) wherein said lubricant comprises 0.5 to 1.4 mass % friction modifier comprising glycerin monooleate, and at least two of a 0.05 to 0.2 mass % alkali metal or alkaline earth metal salicylate in terms of metal element as sulfur-free metal detergent (B), a 0.01 to 0.1 mass % zinc dialkylphosphate in terms of phosphorus elements as a sulfur-free phosphorus compound (C), and a a 0.5 to 2 mass % sulfur-free ashless anti-oxidant (D); and (d) wherein said lubricant is free of sulfur-containing additives selected from the group consisting of zinc dithiophosphate, sulfur-containing metal detergents, and mixtures thereof.

5. The system according to claim 1, wherein said alkali metal or alkaline earth metal salicylate comprises an overbased calcium salicylate containing calcium carbonate.

6. The system according to claim 1, wherein said sulfur-free ashless anti-oxidant (D) comprises octyl-3-(3,5-di-tert-butyl-4-hydroxyphenyl)propionate.

7. The method according to claim 3, wherein said alkali metal or alkaline earth metal salicylate comprises an overbased calcium salicylate containing calcium carbonate.

8. The lubricant according to claim 4, wherein said alkali metal or alkaline earth metal salicylate comprises an overbased calcium salicylate containing calcium carbonate.

9. The lubricant according to claim 4, wherein said sulfur-free ashless anti-oxidant (D) comprises octyl-3-(3,5-di-tert-butyl-4-hydroxyphenyl)propionate.

10. The lubricant according to claim 3 wherein said sulfur-free ashless anti-oxidant (D) comprises octyl-3-(3,5-di-tert-butyl-4-hydroxyphenyl)propionate.

* * * * *